US008087998B2

(12) United States Patent
Silvestro

(10) Patent No.: US 8,087,998 B2
(45) Date of Patent: Jan. 3, 2012

(54) PLAYER-CENTRIC GAMING REWARDS METHODS

(75) Inventor: Frank J. Silvestro, Tuckerton, NJ (US)

(73) Assignee: Bally Gaming, Inc., Las Vegas, NV (US)

( * ) Notice: Subject to any disclaimer, the term of this patent is extended or adjusted under 35 U.S.C. 154(b) by 1147 days.

(21) Appl. No.: 11/854,402

(22) Filed: Sep. 12, 2007

(65) Prior Publication Data

US 2009/0069074 A1 Mar. 12, 2009

(51) Int. Cl.
*A63F 9/24* (2006.01)

(52) U.S. Cl. ..... 463/25

(58) Field of Classification Search ..... 463/25
See application file for complete search history.

(56) References Cited

U.S. PATENT DOCUMENTS

| | | | | |
|---|---|---|---|---|
| 5,655,961 | A * | 8/1997 | Acres et al. | 463/27 |
| 5,697,844 | A * | 12/1997 | Von Kohorn | 463/40 |
| 6,015,344 | A | 1/2000 | Kelly et al. | |
| 6,364,768 | B1 | 4/2002 | Acres et al. | |
| 6,605,001 | B1 | 8/2003 | Tarantino | |
| 7,086,947 | B2 | 8/2006 | Walker et al. | |
| 7,118,479 | B2 | 10/2006 | D'Amico et al. | |
| 2002/0065123 | A1 | 5/2002 | Packes, Jr. et al. | |
| 2003/0100360 | A1 | 5/2003 | Manfredi et al. | |
| 2004/0143496 | A1 | 7/2004 | Saenz | |
| 2009/0131143 | A1 * | 5/2009 | Kelly | 463/19 |
| 2009/0227362 | A1 * | 9/2009 | Kelly et al. | 463/25 |
| 2011/0086701 | A1 * | 4/2011 | D'Amico et al. | 463/29 |
| 2011/0118004 | A1 * | 5/2011 | Kelly et al. | 463/20 |

* cited by examiner

*Primary Examiner* — Pierre E Elisca
(74) *Attorney, Agent, or Firm* — J. P. Cody, Esq.; Philip Anderson, Esq.

(57) ABSTRACT

Gaming systems, machines and methods are disclosed that provide various player-centric rewards to the casino patrons. The rewards may be provided across multiple games including slots, tables, keno, and any other casino game. The sweepstakes rewards may be used to promote increased play for chosen time periods, locations, and/or individual players. In addition, patrons can earn sweepstakes rewards based upon the amount of coins played at the slot machine, on the slot floor or throughout the entire casino. Furthermore, the patrons can receive a birthday reward, which may be credited to the eligible patrons on or about the patron's birth date. The rewards may be directly credited to the gaming machines using either cashable or non-cashable credits. The system facilitates patrons continuing to accrue rights toward a reward even when playing different gaming machines, or when playing machines having different denominations.

22 Claims, 25 Drawing Sheets

```
ABC Casino Systems Corp.      MM/DD/YYYY
          Power Sweepstakes Rewards

Power Sweepstakes Rewards Is active on the system.

Which mode do you wish to enter? M A=Activation Controls
                                 M=Maintain Power Sweepstakes Rewards

F3=Exit F7=Continue Processing
-------------------------------------------------------------
```

FIG.10

```
ABC Casino Systems Corp.      MM/DD/YYYY
          Power Sweepstakes Rewards

Power Sweepstakes Rewards Active? Y (N=No, Y=Yes)
Is active on the system.

F3=Exit F7=Change Control Value
-------------------------------------------------------------
```

FIG.11

SPSMB809 1/20/06 1:54 PM

Power Sweepstakes Rewards

| | | | | | | | | |
|---|---|---|---|---|---|---|---|---|
| .01 | 15 | 15 | 0 | 0 | 0 | 0 | FJS0001 | FJS01 |
| .02 | 15 | 15 | 0 | 0 | 0 | 0 | FJS0001 | FJS01 |
| .05 | 15 | 15 | 0 | 0 | 0 | 0 | FJS0001 | FJS01 |
| .10 | 15 | 15 | 10 | 10 | 0 | 0 | FJS0001 | FJS01 |
| .20 | 15 | 15 | 10 | 10 | 5 | 5 | FJS0001 | FJS01 |
| .25 | 15 | 15 | 10 | 10 | 5 | 5 | FJS0001 | FJS01 |
| .50 | 15 | 15 | 10 | 10 | 5 | 5 | FJS0001 | FJS01 |
| 1.00 | 15 | 15 | 10 | 10 | 5 | 5 | FJS0001 | FJS01 |
| 2.00 | 15 | 15 | 10 | 10 | 5 | 5 | FJS0001 | FJS01 |
| 2.50 | 15 | 15 | 10 | 10 | 5 | 5 | FJS0001 | FJS01 |
| 5.00 | 15 | 15 | 10 | 10 | 5 | 5 | FJS0001 | FJS01 |
| 10.00 | 15 | 15 | 10 | 10 | 5 | 5 | FJS0001 | FJS01 |
| 20.00 | 15 | 15 | 10 | 10 | 5 | 5 | FJS0001 | FJS01 |
| 25.00 | 15 | 15 | 10 | 10 | 5 | 5 | FJS0001 | FJS01 |
| 50.00 | 15 | 15 | 10 | 10 | 5 | 5 | FJS0001 | FJS01 |
| 100.00 | 15 | 15 | 10 | 10 | 5 | 5 | FJS0001 | FJS01 |

ACT: = Change or = Delete or = Display

F1=?? F3=Exit

FIG. 15

SPSMB809 1/20/06 1:56 PM

Power Sweepstakes Rewards Change

.01 FJS0001

15 15 59

0

0

Reward Amount can not exceed 65535.

Press ENTER key to Change or Delete.

F1=?? F3=Exit F12=Previous F13=Card-Level-1 Show F14=Card-Level-2 Show
F15=Card-Level-3 Show F18=Select Power Reward Code

FIG. 16

SPSMB809 1/20/06 1:57 PM

Power Sweepstakes Rewards is the remaining of the existing Lucky Star feature.
Is an existing SMS marketing feature where the customer set by slot denomination the amount of monies (Power Sweepstakes Limit) to be played at the slot machines to cause a Power Sweepstakes to be generated. The SMS slot machine code increments its Power Sweepstakes Counter for each coin played while any patrons card is inserted, once the Power Sweepstakes Counter increment reaches the Power Sweepstakes Limit a Power Sweepstakes transaction id 078 is generated and forwarded to the iSERIES.

Is an existing SMS feature where the customer sets up a promotion and assigns patrons to the promotion. The set up includes the amount of monies the patron must play receive the This new feature is the combining of the two existing features into a new one, this allows the user to assign by slot denomination, and by patrons card-levels if the patron who earns a Power Sweepstakes is to receive a Power Rewards as well!

SMS Power Sweepstakes feature must be active. Power-Rewards License Key SMS-005-Cashable Power-Rewards, and/or License Key SMS-006 for Non-Cashable Power Rewards, and License Key SMS-014 for the feature.

Enter=Return, F1=Next

FIG. 17

SPSMB809 1/20/06 1:57 PM

Power Sweepstakes Rewards

The base denomination of the slot machines included, or excluded if the Reward amount is zeros.

Is the Power-Reward code assigned to this slot denomination.

Is the amount of monies the patron is to receive by card level, if they earn a Power Sweepstakes on this slot denomination, zeros indicates no reward for the card level for this slot denomination.

Is the number of days the patron has to receive the amount of monies they earned, this is the number of days added to the date and time they earned the Power Sweepstakes.

Is the iVIEW show number to be displayed to the patron at the Slot Machine when they earn the Power Sweepstakes Reward, text message will display if the show number set to zeros, or show number does not exist on the iVIEW.

Enter=Return, F1=Next

FIG.18

SPSMB734 1/23/06 8:35 AM

****** Lucky Stars ******

| | | | | | |
|---|---|---|---|---|---|
| 1 | 1 | 100 | .05 | NOVAMATIC | 01 |
| 1 | 2 | 100 | .05 | COINMASTER | 02 |
| 1 | 3 | 100 | .05 | BALLY 5000 | 03 |
| 1 | 4 | 100 | .05 | SAS | 04 |
| 1 | 5 | 100 | .05 | UNIVERSAL | 05 |
| 1 | 6 | 100 | .05 | WORLD-TOUCH | 06 |
| 1 | 7 | 100 | .05 | ISD | 07 |
| 1 | 8 | 100 | .05 | SS | 08 |
| 1 | 9 | 100 | .05 | SS | 09 |
| 1 | 10 | 100 | .05 | WMS REEL | 10 |
| 1 | 11 | 100 | .05 | WMS VIDEO | 11 |
| 1 | 12 | 100 | .05 | SAS | 12 |
| 1 | 13 | 100 | .05 | ISD VIDEO | 13 |
| 1 | 14 | 100 | .05 | BALLY REEL | 14 |
| 1 | 15 | 100 | .05 | SAS | 15 |

Act = Change, = Delete, or = Display
New name of feature:
F3=Exit F5=Change by Dollar Limit F9=Add

FIG.19

FILE NAME: SFPLR
DESCRIPTION: SWEEPSTAKES- REWARDS LINKS

| DESCRIPTION | NAME | LEN | STARTS | ENDS |
|---|---|---|---|---|
| CARD LEVEL 1 AMOUNT | CT1$LR | 11.2 | 1 | 6 |
| CARD LEVEL 1 DAYS TO CLAIM | CT1DLR | 5.0 | 7 | 9 |
| CARD LEVEL 2 AMOUNT | CT2$LR | 11.2 | 10 | 15 |
| CARD LEVEL 2 DAYS TO CLAIM | CT2DLR | 5.0 | 16 | 18 |
| CARD LEVEL 3 AMOUNT | CT3$LR | 11.2 | 19 | 24 |
| CARD LEVEL 3 DAYS TO CLAIM | CT3DLR | 5.0 | 25 | 27 |
| DENOMINATION | DEN$LR | 7.2 | 28 | 31 |
| REWARDS PROMOTION CODE | PRCDLR | 7 | 32 | 38 |
| CARD LEVEL 1 SHOW # | SHO1LR | 3.0 | 39 | 40 |
| CARD LEVEL 2 SHOW # | SHO2LR | 3.0 | 41 | 42 |
| CARD LEVEL 3 SHOW # | SHO3LR | 3.0 | 43 | 44 |
| USER LAST MODIFIED BY. | USIDLR | 5 | 45 | 49 |

FIG.21

SPSMB738 Maintain SMS Systems Values 1/16/06 4:29 PM

Days before purging data 7
Seconds to delay SMSMSGPOL 10
Minutes before bypass MESSAGES 5
Minutes to delay SMSCRDTEST 5
Log FILL BUFFER transactions (Y/N) N
Minutes to delay SMSRATPOST 2
AUTO 102/132 commands (Y/N) Y/Y
Slot Ops. Print (Y=Yes, N=No) N
Hours of no meter changes 0
Points For Bonus/Bonus Points 0 0
Gen. Slot Drop Card-Ins, Y,N,1,2,3 N
Min./Max. $$$ Withdrawal 5 5000
Start Time Gaming day HHMMSS 8:00:00
Hours in Gaming day 001-024 24
Daily Cash Point Limit 0
Handle pull limit per minute 30
Local Corp. & Local Property Id. B 1
Display Countdown ALL Levels (Y/N) Y
Dsply Congrat's Msg on Cash Pnt Y/N N
Seconds To Delay Withdrawal 5
Delay Withdrawal if BAL. *LE $$$ 5
Pnt. Var.Reset Acct / Dlt Slot 2/ 2
F3=Exit F23=To Continue Trans. per minute to delete asset 30
Compute Minutes Behind (Y=Yes,N=No) Y
Minutes to Notify HOST is Behind 0
Minutes Behind to Display Behind 2
*Lucky Stars Active (Y=YES, N=No) Y*
1st Day Double Point Limit, Y/N 0 N
Minutes to delay SMSECHOTST 15
Mult Card Levels (Y/N) Y Pnts $$$.¢¢
1st Day Bonus Point LVL 1,LVL 2,LVL 3
0 .00 0 .00 0 .00
Test Points to Coin-In 0/1/2/3 0
Log Timed Meter Reads (Y=Yes, N=No) N
Inactive hours to force Flush 4.0
Gen. Vald.Drop Card-Ins, Y,N,1,2,3 N
Gear Box for Slot Scale Drop 65
Additional Gear boxes for Slot Scales
00 00 00 00 00 00 00 00
Require PIN to LOCKOUT Slot: N
Express Jackpots Active N
Download iVIEW shows at HOUR: 0

FIG.22

SPSMBxxx XYZ Casino Systems Corp

Power Sweepstakes rewards Maintenance (mm/dd/yy) (time)

| Slot Denomination | Card Level 1 Amount | Card Level 1 Days | Card Level 2 Amount | Card Level 2 Days | Card Level 3 Amount | Card Level3 Days | Rewards Code |
|---|---|---|---|---|---|---|---|
| .25 | $15 | 15 | $10 | 10 | $00 | 00 | EBONUS1 |
| .50 | $20 | 15 | $15 | 10 | $10 | 05 | EBONUS2 |
| 1.00 | $30 | 20 | $20 | 15 | $15 | 10 | EBONUS3 |
| 5.00 | $50 | 25 | $30 | 20 | $20 | 20 | EBONUS4 |

F3=Exit, Press Enter to apply updates.

**********

Note: A zero Card Level Awarded indicates no Bonus Reward for the Card Level and slot denomination combination.

FIG.23

PLAYER-CENTRIC GAMING REWARDS METHODS

CROSS-REFERENCE TO RELATED APPLICATION

This application is related to co-pending U.S. patent application Ser. No. 11/854,448 titled "Networked Gaming System with Player-Centric Rewards" filed Sep. 12, 2007 and U.S. patent application Ser. No. 11/854,424 titled "Gaming Machine With Player-Centric Rewards" filed Sep. 12, 2007.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of the Invention

The field of the invention relates to wagering games processes, and more specifically to methods for providing player-centric gaming rewards.

2. Description of the Related Art

Modern gaming establishments offer a variety of electronic wagering games including multimedia and/or mechanical slot machines providing video card games, such as poker, blackjack and the like, video keno, video bingo, video pachinko, and various other video or reel-based games. In addition, casinos offer a variety of table games, such as poker, blackjack, craps, roulette, and the like. In many instances, the slot machines and table games are computerized or include electronic circuitry performing various functions, and are connected via a networked gaming environment to a host computer and associated servers.

Software programs provide gaming establishments with the ability to compile information about casino players, to monitor the status of games, and to provide promotions, bonuses, and rewards. Examples of promotions include advertisements and rewards, which serve as incentives for casino players to continue wagering and to return to the same establishment.

For example, one gaming bonus or reward, called "Lucky Stars", has been used since the 1989 timeframe at the Sands in Atlantic City, N.J. in conjunction with its slot management (SMS) and casino management (CMS) systems (today's Bally/ACSC SMS and CMS, respectively) and may be described as follows:

"Lucky Stars transactions" may be generated for patrons with their patron card inserted into a casino asset card reader such as are commonly found on slot machines. According to one implementation, from a user (host) interface of the SMS slot system, a casino may select the amount of monies (whole dollars) to be played at an asset, such as a slot machine, prior to awarding a Lucky Star. Once selected, the whole dollar amount is converted by the SMS according to the slot denomination of the asset into a number of clicks (coins to be played), and the number of clicks is downloaded to the gaming machine as the Lucky Star Limit. Once the Lucky Star Limit is set, a counter at the gaming machine will increment the Lucky Stars Count for each coin played while any patron card is inserted. After each increment, the current Lucky Stars Count is compared with the Lucky Stars Limit. The incrementing and accumulation continues as successive patrons utilize the gaming machine. Once the Lucky Stars Count matches the Lucky Star Limit, the slot machine generates a "Lucky Stars transaction" for transmittal to the CMS, resets the Lucky Stars Count back to zero, and re-initiates incrementing the Lucky Stars Count. When the "Lucky Stars transaction" message is received by the CMS, it may randomly or by design determine if the patron is to receive a sweepstakes entry or other award for earning a "Lucky Star". Once a determination is made, the CMS causes a record to be generated and the patron that caused the "Lucky Stars transaction" to be generated is notified of the available award that has been assigned to the patron's account by a message, either transmitted to the gaming machine where the patron has his/her card inserted or the next time that the patron's card is utilized.

These types of rewards and others are popular, and, there continues to be a need to develop creative methods and systems to provide various types of rewards to patrons.

BRIEF SUMMARY OF THE INVENTION

In accordance with the invention/s, gaming methods are provided that offer one or more player-centric rewards to players, such as a sweepstakes entry, birthday reward, or gaming reward, triggered by an occurrence specific to the player, such as the player having a birthday or playing a pre-set amount at one or more games. In one aspect, a player-centric gaming reward and/or promotion offered to a player may be based on criteria such as a player rating and/or wagering denomination.

Other features and numerous advantages of the various embodiments will become apparent from the following detailed description when viewed in conjunction with the corresponding drawings.

BRIEF DESCRIPTION OF THE DRAWINGS

FIG. 10-23 are example displays of a rewards program user menu in accordance with various embodiments.

DETAILED DESCRIPTION OF THE INVENTION

Figure 1:
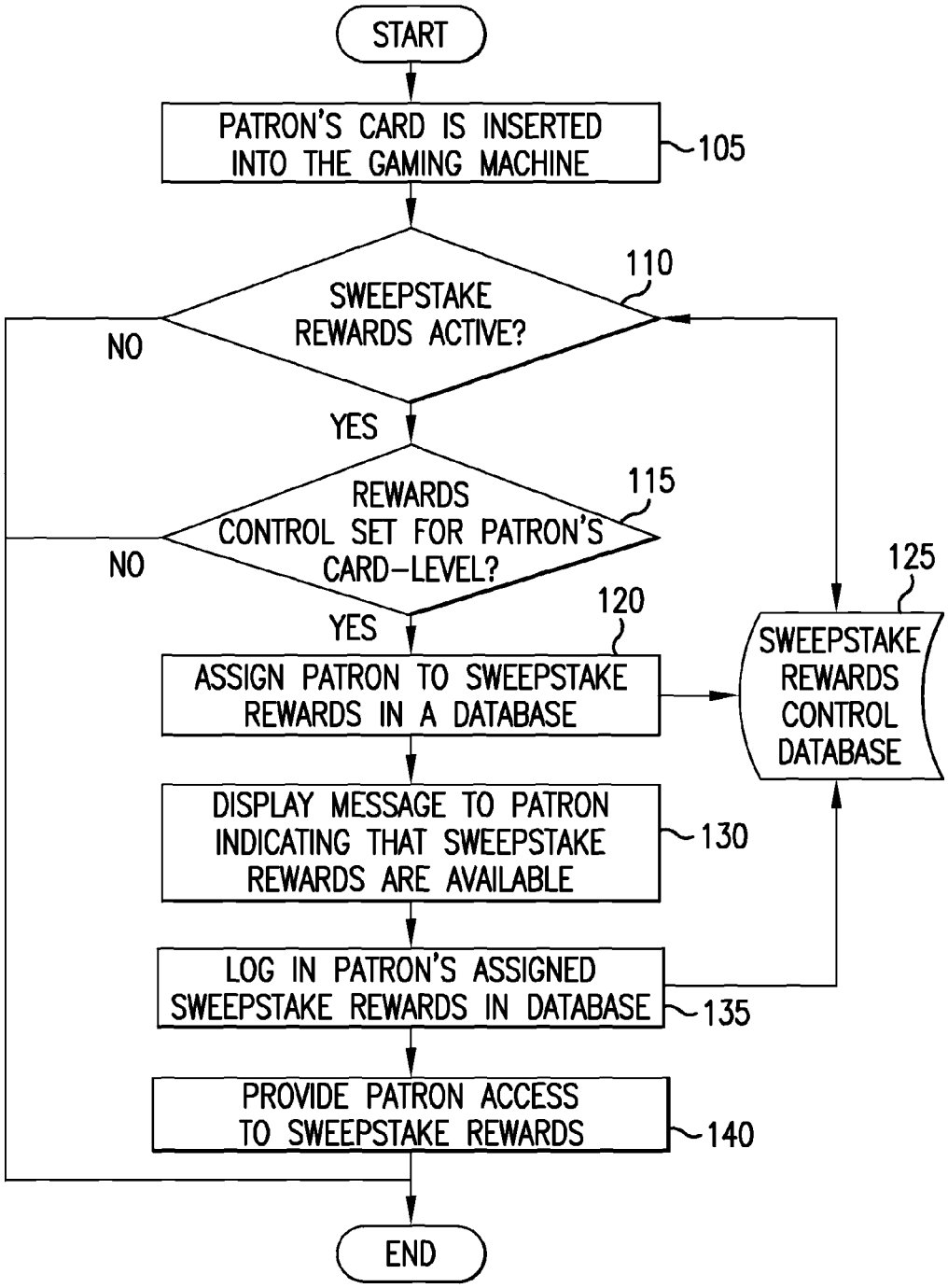
FIG. 1 illustrates an example flow diagram of an example sweepstakes award transaction in accordance with various embodiments.

Referring now to the drawings, wherein like reference numbers denote like or corresponding elements throughout the drawings, and more particularly referring to FIG. 1, a flow diagram illustrates an example award transaction process, such as may be utilized to provide player-centric rewards to eligible patrons based upon pre-selected criterion, in accordance with one or more embodiments. In the example shown in FIG. 1, the award is a sweepstakes entry which may be an entry for a sweepstakes of the quick draw variety that allows an operator to instantly determine the prize won by the particular sweepstakes entry or the entry may be for a sweepstakes of the raffle variety where the selection of winning entries may be made at some time in the future. It may be appreciated that the award may be any type of award including a cash bonus, playing credit, gifts of merchandise, gifts of services, or a player-centric game, to name a few. The award which may be offered through the award transaction process may be one of various levels of rewards depending upon the outcome of the process and the patron may thereafter be offered the opportunity to select a prize from one of the prizes available at the offered award level. The offered prizes may be any such as identified above for the various types of rewards. As an example, a player-centric game with various awards may be offered based on the player level and have various tiering of the awards based on the player level. As an additional aspect, several player-centric games may be offered to a patron based on known preferences, such as may be stored in a database, or based on demographic information.

In the example sweepstakes award transaction process of FIG. 1, a patron may be identified (step 105); a determination may be made whether an award is available (step 110); according to pre-specified player-specific criteria, a determination may be made whether the patron is eligible for an award (step 115); if the patron is eligible, then a determination may be made as to what award may be offered to the patron (step 120); a transmission of an award message may be sent to the patron (step 130); an award record associated with the patron may be created (step 135); and the patron may be provided with an opportunity to redeem the reward (step 140).

Patron identifying step 105 may, by example, be performed by passing an identification card by or into a card reader, such as an optical card reader, by visually identifying the patron, by proximity emitter and/or identity sensor, such as a biometric sensor, or any other direct or indirect method that reasonably identifies and/or associates a patron with a game, gaming apparatus, and/or gaming system. If used, an identification card or device may utilize barcoding or a data strip, such as a magnetic strip, for providing identification information. One or more sensors within an operator's facility may be used to receive the information to identify the patron. For instance, various gaming machines have a player interface which may permit a patron to insert a patron or player card into a card reader. An example of a patron interface unit that is found implemented with various gaming machines is the Bally iView interface unit, such as is described in U.S. patent application Ser. No. 10/943,777, entitled USER INTERFACE SYSTEM AND METHOD FOR A GAMING MACHINE, which is herein incorporated by reference. In one or more embodiments, a patron may enter a user identification and/or password to provide identification information at a gaming machine or within an operator's facility; in such instances, a patron may be able to obtain additional access to the patron's player account and be able to make transfers, such as transferring credits from the player account to a gaming machine for wagering or accepting an award that has been posted to the player account.

Once a patron has been identified, that person's player information may be retrieved from the operator's player database, then an operator may track the wagering and/or spending habits of the patron and utilize a variety of statistics to determine appropriate situations for offering various bonuses or rewards, such as sweepstakes entries, promotions, coupons, or rewards for playing or spending at the operator's facilities. The player information may contain personal information such as birthday, address, etc. and may also contain the patron's gaming and/or spending history within the operator's facilities and possibly at other facilities. The patron's gaming and/or spending history may simply summarize the patron's previous activities. Also, the player information may include a rating of the patron which may be developed from the patron's gaming and/or spending history in accordance with the operator's criterion; for example, an operator may rate patron's at a gold player level if historically the patron bets more than $10,000 and spends four hours or more, five or more times per month or if the patron spends more than $1000 on goods or services within the operator's facilities, five or more times per month. The operator may have various player/patron levels or ratings, such as gold, silver, and bronze, with various criterion to associate with each patron level or rating.

Award availability step 110 may, by example, be performed by simply checking to see if a game, gaming apparatus, and/or gaming system is currently set, programmed, or otherwise enabled to provide rewards to eligible patrons, such as patrons who have identified themselves by inserting their player cards into player tracking units associated with respective slot machines. For example, when a patron inserts a player card into a player card reader attached to a slot machine, a program on the gaming machine may be installed and become active upon the player card insertion. The card reader transmits the player information to a processor which may in turn be a signal to execute a program or protocol. As the program is executed by the processor, steps in the program may include querying a player database to request the player information associated with the identification obtained from the player card. Upon receipt of the player information or selected portions thereof, such as player level or rating, the program may include conditional portions of code which may operate depending upon the player level or rating. For instance, in the event that the player level or rating is gold, then a count limit may be set to a number of credits corresponding to $100 of wagers, the count limit could be decremented according to the number of credits wagered until the count limit reaches zero or alternatively a counter could be used to accumulate the total number of credits wagered until the count in the counter matched the count limit. The described steps of the program may be implemented on a slot machine or other gaming machine or device operated by a patron or the program may be implemented on or through other devices, such as a player tracking server. In either case, the program may be installed and active or not active depending upon the choice of the operator and the award availability step 110 may take place as background processing having no impact on a game being played by a patron until and unless the patron played sufficiently to meet any predetermined criteria associated with any active award program.

Alternatively, player-centric rewards may always be available subject to predetermined constraints which may be editable by the operator. In such cases, step 110 may be modified according to the particular implementations such as those discussed by example. For instance, award availability step 110 may include a determination of whether one or more pre-determined criteria have been met by the patron, thereby making the patron eligible to receive an award, such as cash, a sweepstake entry, and/or a sweepstake award. Example pre-determined criteria may be that the patron wager a predetermined amount of money or wagered a pre-determined amount of money within a pre-determined amount of time or spent a pre-determined amount of money at a game, a gaming apparatus, a casino facility, and/or a gaming system. Other examples of pre-determined criteria may be that the patron enters a facility within a pre-determined number of days of their birthday, wedding anniversary, anniversary of establishing a player card, or other day associable with the patron. Other examples of pre-determined criteria may be that the player entered the facility and/or played a game during a pre-determined time of a pre-determined day, or may be that the player was drawn from a random or pseudo-random drawing either before or after entering the facility and/or playing a game, or may be any of various events associable with the patron. Any of the pre-determined criteria, such as the pre-determined amount of money to be wagered, may be determined by the operator of the game, gaming apparatus, and/or gaming system.

As shown in FIG. 1, the award may be a conventional sweepstake entry. The sweepstake entry may be an entry which can be instantly included in a drawing, such as one based on a random or pseudo-random number generator, or may be an entry included in a pool for a later drawing, or may be an entry with a number that was randomly or pseudo-randomly determined and which may be compared as against a list of prize-winning numbers. In any of the example cases, there may be a variety of levels of prizes or there may be a single prize, such as a new car or large cash fund. Limitations may be placed on the sweepstake entry, such as that the patron may be required to be present at the time of the drawing in the case of a later drawing or the patron must come into the facility on the day of the drawing or redeem any winning sweepstake entry within a pre-determined period of time. Any of the limitations or pre-determined criteria may be modified by an operator according to player criteria, such as player rating or player playing frequency, etc. For example, player ratings for a facility may be platinum, gold and silver where the ratings may be determined from various criteria associable with a player, such as the amounts wagered, frequency, and type of game played. As an example, a platinum player may have three days to redeem a sweepstakes entry, and gold player may have two days, and a silver player may have to redeem the sweepstakes entry on the day an award is offered.

In one or more embodiments, in the event that the rewards functionality is activated and the patron is eligible for an award, patron eligibility step 115 may, by example, include a determination whether a player's rating meets a pre-specified rating level to receive an award, and/or, the determination may include whether the player may be eligible to receive a pre-determined level of award. In some cases, there may be more than one prize that may be available at an award level and a patron who is eligible may have an opportunity to select a prize from the one or more available prizes at a determined award level.

Depending on the outcome of the patron eligibility step 115, steps for award and redemption opportunity (such as by example, steps 120, 130, 135) may be included. The steps for award and redemption may be as simple as an agent for the operator or an automated award system selecting an award and delivering the award to a patron for acceptance, either directly or by separate offer through a player account. In other embodiments, the patron may be entered into an instant or subsequent sweepstakes. In such cases, the patron may be provided with a record of the patron's entry into the sweepstakes or may be provided with or offered an award as the result of a winning entry.

Notification step 130 may be any form of messages including verbal or visual which may be perceived by the patron, e.g. an award notification message sent from a player server and displayed on the player tracking display or an award notification sent in the mail. In the case of a notification by mail, a patron may have a pre-specified period of time, such as thirty days, to return to an operator's facility to redeem the award.

Logging step 135 may comprise any method or system for recording information which the operator may use to maintain records of its rewards. For instance, an award database may be maintained by an award server which may comprise a conventional computer with a hard drive and an award program causing award records to be entered and stored when the program is executed by the computer.

Patron access step 140 may comprise any method or system providing a patron with an opportunity to receive and/or accept a reward offered to the patron by the operator. For example, a patron may be able to accept and receive an award by putting the patron's card into a player card reader at a gaming machine, entering the player card personal identification number (PIN) on a player interface such as a keypad, and making a request and/or responding to any prompt from a player tracking server.

One or more embodiments may include establishing a Count Limit which may be associated with a patron identified at a gaming machine. The Count Limit may be decremented after each play by the patron in accordance with the amount of the wager or number of credits wagered. The Count Limit may be a dollar amount, such as $100, $1000, $10000, etc. or may be an amount in terms of a non-U.S. currency. Alternatively, the Count Limit may be a number corresponding to credits required to be wagered prior to becoming eligible for an award. The Count Limit may be changed in terms of denominations wagered and associated with a credit. For instance, a Count Limit for a $1 slot machine may be one hundred; a corresponding Count Limit for a $0.25 slot machine may be four hundred, and so forth. A Count Limit may be associated with each patron and decremented according to the patron's play. Alternatively, multiple Count Limit's may be associated with a patron according to credit denominations, such as $1, $0.25, $0.05, etc. slot machines. For instance, each Count Limit may be 1000 and a Count Limit may be associated with penny, nickel, quarter, and dollar wagering such that when a patron wagers at a quarter slot machine the Count Limit associated with quarters is decremented. Additionally, an operator may select a weighted Count Limit to favor patron's at higher denomination slot machines. For example, an operator may establish a Count Limit of 100 for $1 slot machines, a Count Limit of 600 for $0.25 slot machines, and so forth. In the event that an award system includes a feature for a patron to have a Count Limit carry from slot machine to slot machine, then the Count Limit may adjust to the lowest denomination wager that the patron plays in order to become eligible for an award. For example, a patron may begin playing on a $1 slot machine and a Count Limit for the player may be set at 100. The patron may play 50 credits and then move to a $0.25 slot machine. If the award system is set for a patron to have a single Count Limit as opposed to a denomination specific Count Limit and also includes the capability to carry a count to another slot machine, then the count may have a one to one credit adjustment so that the Count Limit may be adjusted to two hundred or if there is a fifty percent higher Count Limit for $0.25 denomination wagering, the Count Limit may be adjusted to three hundred. Thus, when a patron plays at a different denomination game, then the Count Limit associated with that denomination is decremented with each credit wagered.

The current Count Limit for a patron may be displayed for a patron so that the patron may view as the Count Limit decrements towards zero. When the Count Limit reaches zero, then an award may be initiated for the patron if the patron meets any additional pre-determined criteria, such as patron player rating. Alternatively, the player rating may determine the type of award or value of the award to be offered to the patron. In the event that a patron does not have a sufficient player rating to participate in the player-centric award program, then no Count Limit is set and none is displayed. Additionally, as a patron plays, the patron may establish an eligible player rating and a Count Limit may thereafter be set and displayed for the patron.

One or more embodiments may include a Count Limit and a Count wherein the Count is incremented with each wager and the Count is compared with the Count Limit. As the Count, or Count Limit as discussed in the preceding paragraph, is personal to the patron when a patron leaves a game, the Count or Count Limit state does not carry over to a next player. Instead, the Count or Count Limit state may or may not carry over for a given patron for another gaming session or on a different gaming machine depending upon the settings established by the operator. In one or more embodiments, the Count, or Count Limit if decremented based on wager, may be retained and associated with a patron so that when the patron returns to play a game, which may be the same or a different game, the Count or Count Limit can continue from where it was at the time the patron ceased previous play. In such cases, the state may be maintained for a pre-determined period of time and then be reset. Also, the pre-determined period may be the same or different depending upon player rating or other player-centric criteria. For example, a gold level player may have the player-centric award game state maintained for three days, while a silver level player may have the game state maintained for two days, or a bronze level player may have the game state maintained only for a few hours. In another embodiment, there is no carry over of the Count or Count Limit which may be used to induce a patron to continue play. A visual or sound aid may apprise the patron of the current status of the Count or Count Limit and provide encouragement to continue until the patron may become eligible for an award. Also, the order of the steps as indicated in the above examples, may be shifted such that an operator may determined that a patron is eligible for an award once the Count or Count Limit criteria is met and the patron may be notified periodically or occasionally, accordingly.

In one or more embodiments, the Count or Count Limit may be applied to a group. For instance, a Count or Count Limit may be displayed to a group of players. As each player wagers, a communal Count or Count Limit is adjusted until a wager causes the final decrement or increment of the Count or Count Limit to achieve the final pre-determined value or decrement to zero. The patron that causes that value to be achieved will be eligible to receive the reward if there are no other criteria to be met. Rewards may be tiered so that the first eligible patron to achieve a pre-determined value may be eligible to receive one level of reward, and the next eligible patron to achieve a second pre-determined value may be eligible to receive a second level of reward, and so forth. Alternatively, consolation or lower tiered (valued) rewards may be offered to those players whose individual Count matches the Count Limit after the first player has done so. Thus, patrons may be incentivized in a competitive environment to play for the next reward level.

Similarly, in one or more embodiments, such a tiered reward system may be implemented for a single patron, so that once a patron achieves one level of Count, such as 1000, then the patron may be eligible for one level of award, such as a selection of stuffed toys or $25 playing credit. By deferring the lower award and continuing to play, the patron may play towards a second level of Count, such as 2500, which once achieved may allow a patron to be eligible for a second level of award, such as a night's stay or a dinner or $50 playing credit. The patron's Count may be incremented either in a single session or over multiple sessions and multiple games.

In one or more embodiments, the Count or Count Limit may be displayed either intermittently or continuously. In an intermittent example, when the patron's credits reach a pre-determined amount or after a pre-determined amount of play or when the patron requests the patron's player card or when the patron requests a cash out, a display or announcement may apprise the patron that the patron may be eligible for an award after another x number of plays. The visual, audible, or written report may indicate that play must be continued within a pre-determined amount of time, such as one hour, one day, one week, one month, etc. in order for the patron to retain the current count. If play is not recommenced within the pre-determined timeframe by the patron then the Count or Count Limit may be reset to the default initial value.

In one or more embodiments, player points may be accrued or bonuses won or granted in addition to the rewards as described herein. For example in parallel and independent of the rewards processes and systems described herein, player points may accrue conventionally through accumulations based on amounts of play and various bonuses awarded included mystery bonuses which may be triggered randomly, pseudo-randomly, or upon an event unknown to the patron, bonuses triggered by an event such as a jackpot win, and progressive bonuses, all or any of which may be funded from portions of coin-in or funded by the operator such as with marketing or advertising dollars.

In one or more embodiments, the player-centric rewards as described in the processes and systems herein may be funded as a portion of coin-in or by operator self-funding such as marketing dollars or by advertisers' prize contributions which are provided in return for advertising exposure, such as a Pioneer Widescreen TV or a Mercedes Benz automobile.

In one or more embodiments, a patron may receive an award directly or indirectly. For example, a patron may receive an award directly in the form of cash or a non-cash prize given at the game. Alternatively, a patron may receive an award indirectly by crediting the player's account as in the example of a cash prize or providing a patron with a notice for redemption in the case of a non-cash prize. A notice for redemption (or advisement that an award has been granted and may be redeemed, etc.) may be displayed to the patron while playing the game or after presenting the patron's player card to a machine or person after the notice has been associated with the patron's player card, etc.

In one or more embodiments, a patron may be given an opportunity to select from a range of prizes for which the patron is eligible. The patron may be notified visually or orally and may make a selection accordingly. The range of prizes may include cash, credit, services and/or tangible prizes.

In one or more embodiments, the referred to prior art award associated with a game, independent of a particular player, may have a Count and/or Count Limit associated with it and an award may be granted or offered to a patron in addition to and independent of the patron's personalized Count and/or Count Limit and rewards associated therewith. The game Count and/or Count Limit may be unknown or made known to a player. In the case of an unknown game Count and/or Count Limit, once a pre-determined amount of gameplay is met, then the award may be granted to an eligible patron such as a mystery award. The patrons may be generally aware of the rewards available but not specifically as to the game upon which the patron plays. In other embodiments, the patron may be notified of the game Count or Count Limit to incentivize the patron to continue playing.

In one or more embodiments, the patron and/or game Count or Count Limit may be pre-determined by the operator or may be randomly or pseudo-randomly established for one or more award categories. Additionally, prizes or their respective categories may be pre-determined by the operator or may be randomly or pseudo-randomly selected, as for example in the case of sweepstakes drawings. By introducing the random or pseudo-random element, larger prizes may be offered at more infrequent intervals as compared to lesser prizes, which may add another level of excitement and opportunity for the patrons.

In one or more embodiments, the prizes may be in the form of restricted or unrestricted credits. In either case, the credits may be credited to the patron's player account or directly to the game where the patron is playing. In the case of restricted credits, a patron may not directly exchange them for cash and may only use them for wagering on one or more games; whereas, unrestricted credits may be exchanged for cash.

Figure 2:
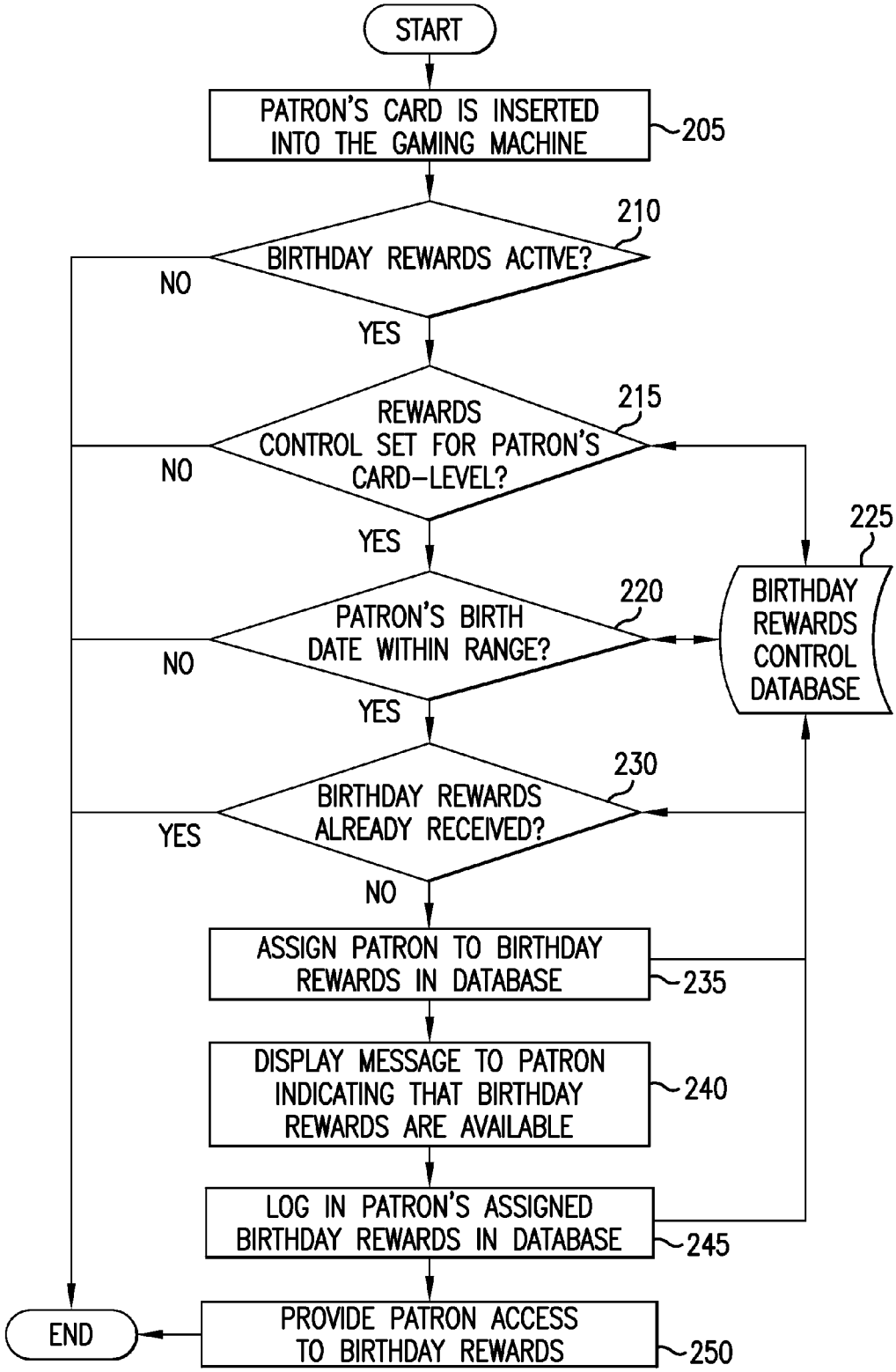
FIG. 2 illustrates an example flow diagram of an example personalized award transaction in accordance with various embodiments.

Referring now to FIG. 2, a flow diagram of a second player-centric rewards transaction process is shown according to one or more embodiments. In this example, the award is a birthday award. In other examples, instead of a birthday, any other day associable with the patron may be selected for offering an award to the patron. For instance, an award may be offered on an anniversary or a holiday, or any other day pre-selected by the operator that may be associated with the patron. The criteria may be based on demographic information or biographical information to provide eligibility for demographic-based or biographical-based rewards, such as for example, patrons from outside the U.S. may be eligible for a demographic-based reward or patrons who are firemen may be eligible for a biographical-based reward.

As in the example process shown in FIG. 1 and discussed above, the corresponding steps shown in FIG. 2 include: identifying the patron (step 205); determining if a type of player-centric award is available (step 210); according to pre-specified player-specific criteria, determining if the patron is eligible for the type of award (step 215) and if so determining and/or assigning the award to be offered to the patron (step 235); transmitting an award message to the patron (step 240); creating an award record associated with the patron (step 245); and providing the patron with an opportunity to redeem the award (step 250).

In the example shown in FIG. 2 where a type of award is active and the patron holds a card-level or rating sufficient for eligibility for the type of award, additional steps within the process include determining whether the current date falls within a pre-determined range of dates or days associated with the patron's birthday (step 220), and, determining whether the type of award has been previously received by the patron (step 230).

With respect to the range of dates in step 220, an operator may select one or more days or time periods as eligible timeframes for a patron to appear at an operator's establishment and/or take part in an eligible activity, such as playing a game provided by the operator. The days or time periods selected by an operator may be symmetric or assymetric about the birthday. For instance, symmetric eligibility periods may be defined as: the day before through the day after for gold rated players; two days before through two days after for platinum rated players; and simply the day of the birthday for silver rated players. On the other hand, there may be no differentiation between player ratings.

With respect to determining whether an award has already been received by a patron in step 230, an operator may establish that the birthday reward may only be offered and received once. In another embodiment, the operator may establish that a patron may receive a birthday award more than once. For example, the operator may select that a birthday award be awardable to eligible patrons during each day of the week of the patron's birthday or once per week during the patron's birth month.

In one or more embodiments, a patron may be eligible and awarded or offered an award for more than one event-driven award, such as a birthday award and an anniversary award or a birthday award and a holiday award, etc. Additionally, the patron may be eligible for and be awarded or offered a sweepstakes or other award based upon the patron's play.

Figure 3A:
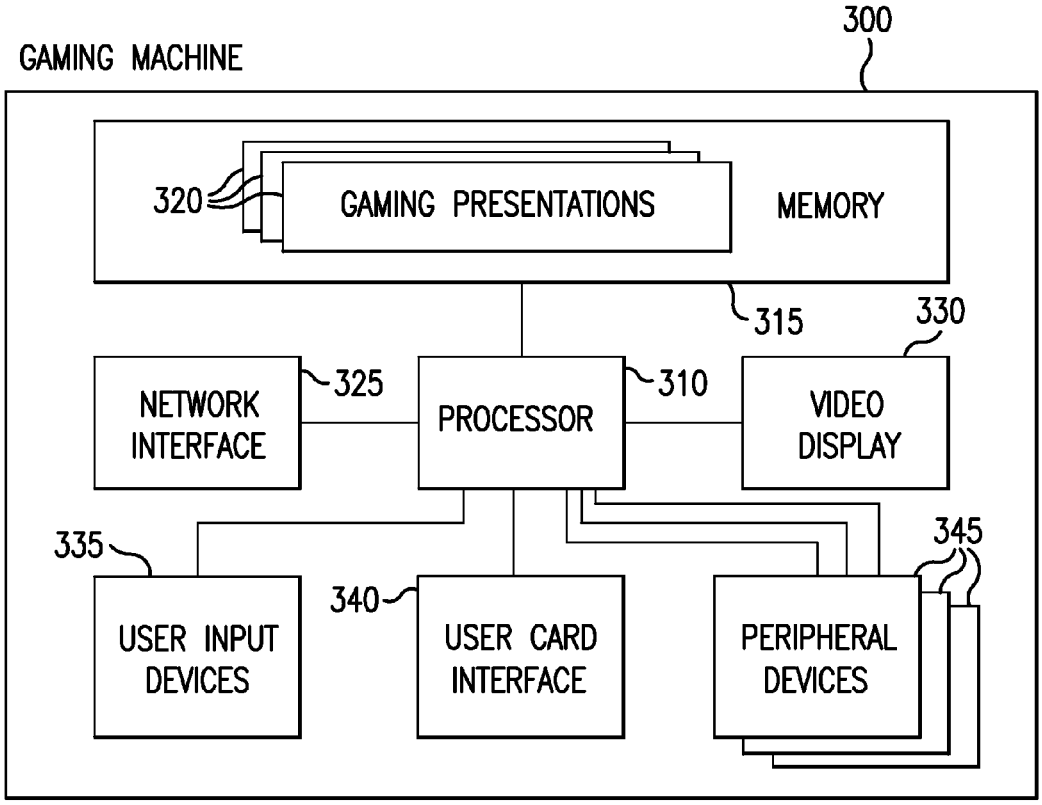
FIG. 3A illustrates an example high-level block diagram of a gaming machine in accordance with various embodiments.
Figure 3B:
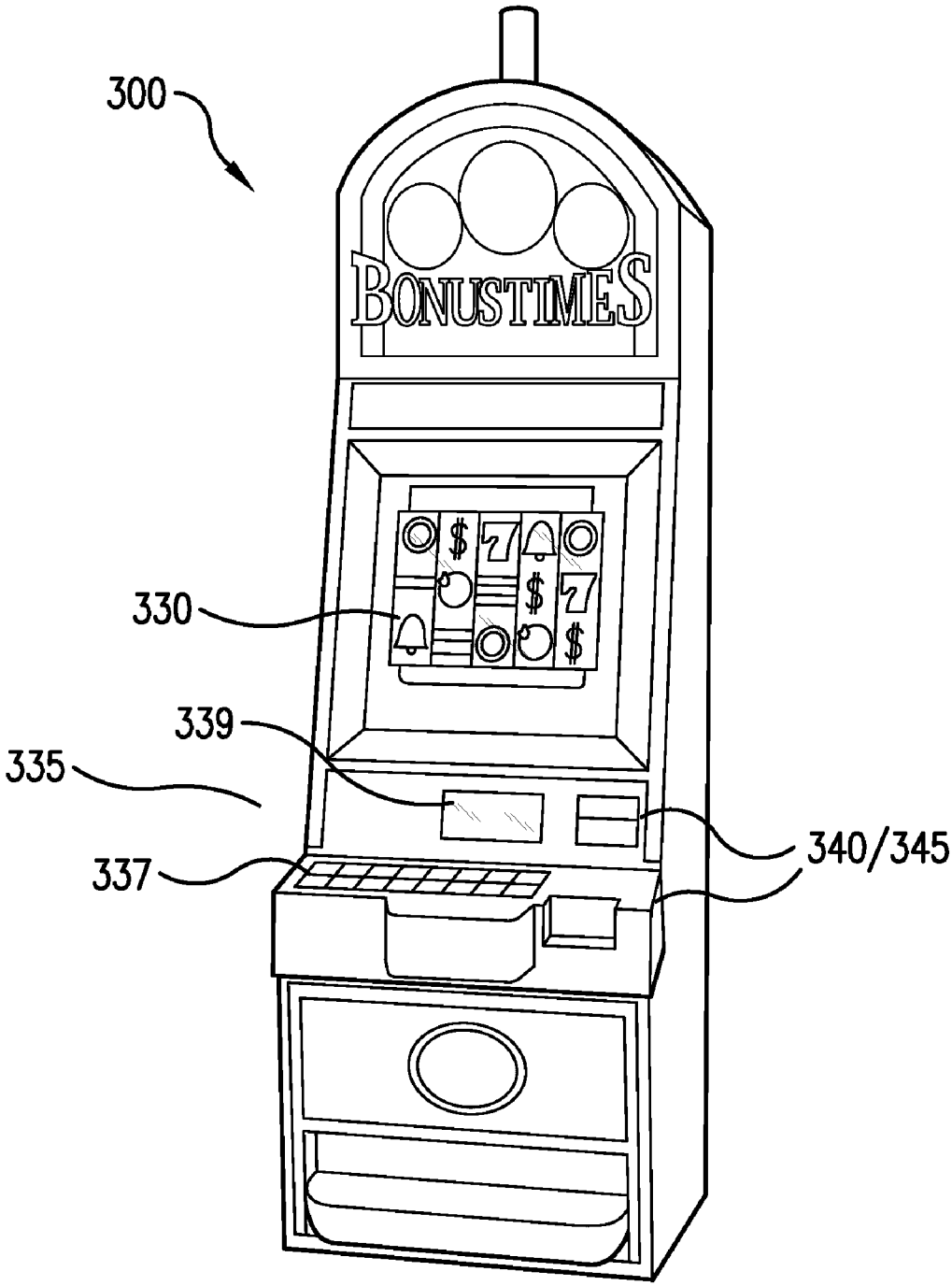
FIG. 3B illustrates an example gaming machine in accordance with various embodiments.

Referring to FIGS. 3A and 3B, a block diagram and front view of example gaming machine 300 are shown, respectively. Gaming machine 300 may include apparatus and/or software for implementing one or more player-centric rewards processes as discussed above and in accordance with one or more embodiments. Typically, gaming machine 300 is implemented as an electronically functional device using conventional personal computer technology with few or no moving parts; however gaming machine 300 may also be implemented as an electro-mechanical or mechanical device.

For example, gaming machine 300 as shown in FIGS. 3A and 3B may include a game printed circuit board including game processor 110, memory 115 which may store the game machine operating system and game presentation software 120, network interface 125 for connecting to an operator's network, video display 130 which may display a game driven by processor 110 and may have fields for example displaying player credits, wager, win amount, etc., user input devices 135 which may provide buttons or video fields for a user to communicate with gaming machine 300 through processor 110, user card interface 140 which may provide a device for transmitting player card information to processor 110, and peripheral devices 145 such as a bill acceptor or ticket dispenser, etc.

In the example of a video gaming machine, game processor 110 communicatively connects to video display 130 which displays images of reels that function equivalently as mechanical or electro-mechanical reels, user interface unit including user input devices 135 which provides information to a patron and permits patron communications with the game processor and/or a network connected through network interface 125, user card interface 140 which provides a device for receiving and reading player card information, and peripheral devices 145, such as a bill reader for receiving and reading various bill denominations, coupons, and/or credit vouchers, and, a voucher printer which may be combined with the bill reader and may print credit vouchers when a patron wishes to cash out and/or print rewards vouchers when a patron accepts an award.

Video display 130 may be any of a variety of conventional displays, such as a high resolution LCD flat panel, and may have touch screen display functionality so that a patron can make software-enabled selections which may be associated with the game. Apart from its conventional functionality in presenting a game for a patron, gaming machine 300 may include award software which may be stored in memory 115 and hardware which may be part of or connected to the game board to implement one or more player-centric rewards processes as disclosed above by example. Video display 130 may include a separate user display such as an LCD touch screen display with interactive capability for communication between a user, gaming machine 300, or a network connectable through network interface 125.

Memory 120 may include both memory internal and external to processor 110. External memory may include a hard drive, flash memory, random access memory (RAM), read only memory (ROM), and any other conventional memory associable with a printed circuit board.

In the event that gaming machine 300 is connected to a network, then the rewards software and hardware may be implemented wholly or partly externally and may be communicatively connected to the user interface unit for notifying patrons of rewards and receiving patron communications, such as award acceptances. For instance, gaming machine 300 may have a game management unit (GMU) which connects to a slot management (SMS) and/or casino management (CMS) network system. The GMU may in turn connect to the game board and the user interface unit. The player-centric rewards may be driven through the GMU, either directly or indirectly through the SMS and/or CMS which is discussed more fully below.

Referring to FIGS. 3A and 3B, typically, gaming machine 300, such as Bally's S9000 Video Slot machine, comprises microprocessor 310, such as an Intel Pentium-class microprocessor, and non-volatile memory 315 operable to store a gaming operating system, such as Bally's Alpha OS, and one or more gaming presentations 320, such as Bally's Blazing 7's or Bonus Times for example, operable and connected on a printed circuit motherboard with conventional ports and connections for interfacing with various devices and controlling the operation of gaming machine 300. Memory 315 may store one or more software modules operable with the OS to implement one or more reward processes, such as are shown in FIGS. 1 and 2 and described above.

Gaming machine 300 may optionally include network interface 325 operable to download one or more gaming presentations 320 from the one or more gaming servers (not shown) and to otherwise communicate with networked devices and servers for various purposes; however, one or more player-centric award processes as described above by example may be implemented with or without network support depending on implementations as is described further below. Gaming machine 300 may further comprise a video display 330, through which gaming presentations are presented to the user; however, electro-mechanically driven reels may be implemented in place of or together with video display 330. Gaming machine 300 may further comprise user interface devices 335, such as a keyboard (not shown) which may be used to enter a pin number or for the selection of various options, various player selectable buttons 337 including bet one, bet all and the like, as well as a touch screen which may be incorporated with video display 330 or display 339, such as an iView TFT display. Gaming machine 300 also includes user card interface 340, which is operable to accept a user card that identifies a user as a casino patron to the gaming environment. Gaming machine 300 may further include one or more peripheral devices 345, such as a bill/ticket acceptor, ticket printer, and various other devices. As shown in FIG. 3B, user card interface 340 and peripheral devices 345, such as a bill acceptor may be implemented adjacent to each other or may be part of the same housing structure while connecting differently to perform their respective functions. In the event a network connection exists, then the user interface unit may provide a communication link for a patron with an SMS and/or CMS network.

In one or more embodiments, gaming machine 300 includes microprocessor 310, which may implement the programming logic of the gaming presentations and control the operation of various hardware and software components of the gaming machine, as well as, one or more peripheral devices 345. For example, microprocessor 310 may be operable to activate various components of the gaming machine 300 and, in the event of a network connection, to download one or more gaming presentations 320 from the gaming server. In response to a user input to initiate play and the placement of a wager, the microprocessor 310 may be configured to retrieve the requested gaming presentation 320 from memory 315 and to commence the play of the game. The microprocessor 310 may be configured to randomly select a game outcome from a plurality of possible outcomes and to cause the video display 330 to depict indicia representative of the selected game outcome. In the case of slots, for example, mechanical or simulated slot reels may be rotated and stopped to display symbols on the reels in visual association with one or more pay lines. If the selected outcome is one of the winning outcomes defined by a pay table, the microprocessor 310 may be configured to award the player with a number of credits associated with the winning outcome. Conventionally, in such gaming machines, a player may wager multiple credits on one or more lines depending upon the programming or physical limitations of the gaming machine.

In accordance with one or more embodiments, microprocessor 310 and/or related software and components may be configured to store a Count or Count Limit in accordance with the example rewards processes described above. For example, one or more registers from the microprocessor random access memory may be utilized to store a Count or Count Limit in accordance with one or more player-centric rewards processes which may be implemented with one or more rewards programs that may be stored in a permanent memory accessible to and compiled and/or executed by the game microprocessor in accordance with the inventions, such as have been discussed by example above and shown in FIGS. 1 and 2.

For instance, in one or more example embodiments, a Count Limit, e.g. Count Limit equals one hundred (which may correspond to one hundred credits or $100 wagered depending upon programming and/or operator elections), may be uploaded to microprocessor 310 and/or related components associated with the game provided by gaming machine 300, such as through a technician's input using the user interface or an alternative interface device, such as a wireless or wire-connected phone, tablet, or personal computer which may connect to gaming machine 300 through an infrared or similar wireless port or through a universal serial bus or similar wire-connected port connecting directly or indirectly to the game board. Where the game board may comprise a conventional personal computer board or one that may be modified for gaming purposes. The technician may be identified as authorized to input the Count Limit based on information obtained through a card reader from a technician's card and/or by the input of a password through user input devices 335, such as a keypad or touch display.

In one or more embodiments, gaming machine 300 includes user input devices 335, which may include various gaming controls, such as standard or game-specific push-buttons, a "bet" button for wagering, a "play" button for commencing play, a "collect" button for cashing out, a "help" button for viewing a help screen, a "pay table" button for viewing the pay table(s), a "call attendant" button for calling an attendant, and a "rewards button" for viewing player reward information and accepting various rewards, such as sweepstakes and birthday rewards. User input devices 335 may also include various game-specific buttons known to those skilled in the art. User input devices 335 may also include a keyboard, a pointing device, such as a mouse or a trackball, or any other input devices. In one or more embodiments, user input devices 335 may also comprise an embedded additional user interface (not depicted), such as an iView™ interface, as described in commonly owned U.S. patent application Ser. No. 10/943,771, entitled USER INTERFACE SYSTEM AND METHOD FOR A GAMING MACHINE, which is hereby incorporated in its entirety by reference herein. The content provided through the embedded additional user interface may include, for example, advertisements, promotion notifications, useful gaming information, user rewards information and any other content that may be of interest to the casino patron.

In one or more embodiments, the gaming machine 300 also includes user card interface 340, which is operative to accept user cards containing the patron's identification information, such as the patron's ID number. User interface 340 may be configured to accept magnetic cards, smart (chip) cards, electronic keys and the like. It will be appreciated, however, that such user information may be stored in other forms or on other media for subsequent retrieval. For example, the user information can be stored on an RFID device, electronic key, or other portable memory device. Likewise, using biometrics or other techniques, user information may be retrieved from the game machine or from a remote storage device via a network. In an example embodiment, the system may recognize three different levels of user cards. For example, level one cards may identify frequent casino patrons, i.e., those who have a well-established history of playing at the given casino and/or whose wagering at the casino exceeds a specified threshold amount. Therefore, level one patrons will be entitled to the greatest degree of service, various promotions and rewards from the casino since they have met or exceeded a game threshold. The level two cards may identify patrons who frequent the casino, but whose spending at the casino is not as extensive as those of the level one card holders. Lastly, the level three cards may identify new casino patrons, i.e., those who do not yet have a consistent history of playing at the given casino. The degree of service, promotions and rewards offered to the level two and level three card holders likely will differ from that offered to the level one card holders, as will be described in a greater detail hereinbelow. The gaming system may be configured to recognize fewer or greater numbers of card levels, and that promotions and/or credits associated with each card level may differ.

In one or more embodiments, gaming machine 300 includes one or more peripheral devices 345. For example, peripheral devices 345 may include a player identification device, such as a magnetic card reader that accepts a player-identification card issued by the casino. Peripheral devices 345 may also include a credit receiving device, such as a coin acceptor, a bill acceptor, a ticket reader, and a card reader, which may be used for placing wagers. The bill acceptor and the ticket reader may be combined into a single unit. The card reader may, for example, accept magnetic cards, such as credit cards, debit cards, and smart (chip) cards coded, i.e., cards loaded with credits or that designate an account for use via the gaming machine 300.

According to the methodology of various example embodiments, a patron may insert a player card to provide identification information to gaming machine 300. A player-centric rewards process, such as disclosed above, may be implemented through a player-centric rewards program stored on permanent storage accessible by the game processor or other local processor, such as a processor connected to a Bally iView or similar unit, and activated by a signal from the card reader. The player-centric rewards program may be a program or programs that may implement the process described by the flowcharts of FIGS. 1 and 2 through execution by processor 310 on gaming machine 300.

The information from the card reader may be processed through a subroutine to determine player eligibility for player-centric rewards. If the player is determined to be eligible, then the program may decrement the value defined as the Count Limit by the number of credits wagered (or the corresponding monetary value if the Count Limit is stored as a monetary value) and update the storage register containing the Count Limit. The program may determine whether the Count Limit is less than or equal to zero. If the value reaches zero or below, then the patron may be determined by the program processing to have qualified for an award, a subroutine may be initiated to determine the award to be offered to the patron, and the Count Limit may be reset to its original value and decremented as the patron continues to play. In accordance with the program processing, the patron player level may be determined, a set of potential prizes or prize levels may be identified for which the patron's player level is eligible, and the award may be chosen from the set of potential prizes or prize levels using a random or quasi-random number generator. In an alternative embodiment, the patron's player level may be identified at the beginning of play and the set of potential prizes or prize levels may be determined for which the patron's player level is eligible, gaming machine 300 may display a message viewable by patron showing the count and/or the set of potential prizes or prize levels for which the patron is eligible. Gaming machine 300 may also provide encouragement to the patron to win an award and one of the potentially available prizes or prize levels by displaying entertaining video images and/or providing audible messages, such as cheerleaders making a 'GO' cheer and/or displaying a fireworks display when pre-programmed levels of play are met by a player.

Upon determining a prize or prize level that is to be offered to the patron, then an instruction from the player-centric award program may direct the processor to transmit a notification to the patron, such as by displaying an informational message on display 330 or 339 advising the patron that he has qualified for an award and providing the patron with one or more options for responding to the notification. Thereafter, the patron may receive a redemption voucher for use at an operator patron service facility or a cash disbursement, such as credits added to the credit meter or a printed cash voucher. When the patron completes play, as by removing the player card from the card reader, then the Count Limit may be reset to its original value prior to a subsequent player initiating play.

In one or more example alternative embodiments, a Count and/or Count Limit may be stored in temporary storage, such as by example one or more registers of a game microprocessor, a player interface microprocessor, digital signal processor, or controller associated with a player interface such as a Bally iView, or a processor associated with a Bally GMU or GTM which may be communicatively connected to the game motherboard and the player interface. Alternatively, the temporary storage may comprise an onboard (motherboard or daughter board) conventional memory, such as random access memory (RAM), or, an off-board connected conventional memory, such as a conventional hard-drive, or, a connected printed circuit board with a conventional processor, controller, and/or memory. The temporary storage value may be defined as the Count which corresponds to the number of credits wagered by an eligible patron during a gaming session. The processor may increment the Count by the number of credits wagered. After each play, the Count may be compared with the Count Limit in accordance with the programmed player-centric award procedure executed by game processor, when the Count is either equal to or greater than the Count Limit, the patron may then qualify for a player-centric award. The programmed player-centric award procedure may then initiate a subroutine to determine an award to be offered to the patron, the Count may be reset to zero, and the Count incrementing and comparison steps may begin again as the patron continues to wager. The award subroutine may include a variety of prize levels which may be determined in accordance with a random or pseudo-random number generator where respective of the selectable numbers correspond to respective prize levels. Once the processor determines the award to be offered, then the procedure instruction set may include an instruction for the game processor to send an award notification to the patron through, by example, display 330 or display 339, or by printing a voucher redeemable at one of the operator facilities providing patron services. In the event of a display notification, the patron may by example be provided the option of having a redeemable voucher printed or, in the case of a cash award, of having credits uploaded onto the credit meter for further play on gaming machine 300. Alternatively, the game processor may cause an electronic award record to be created and transmitted to a data location associable with and accessible on behalf of the patron. Such a data location may be a permanent storage connected to the gaming machine or may be a memory stick or magnetic strip connected to the patron's player card. In the case of records being stored on a patron's player card, a patron may access the award by utilizing a machine readable device for dispensing rewards or by presenting the patron's player card to an operator's representative, such as at a cashier's cage.

In one or more alternative embodiments, a Count or Count Limit may be obtained from information stored or machine readably inscribed on or about patron's player card through the use of user card interface 340 which may have a receptacle to receive player cards or may have a scanner enabling a proximity scan of the information on the patron's player card. The patron's player card may contain the information such as through the use of a memory strip. In such cases, user card interface may have a read-write capability to enable writing the ending state for the Count and/or Count Limit values at the time the patron concludes play on a given gaming session. Thus, a patron may play different gaming machines and play at different times while retaining the state of the patron's Count and being able to continue to accumulate points during each gaming session without losing the value of the Count from the prior session.

Alternatively, when the patron completes play at a given gaming machine, as by removing the player card from the gaming machine card reader, then the Count may be reset to its zero or initial value. In other words, there is no Count or Count Limit state that is saved at the end of a gaming session. Also, the Count will be re-initialized after each instance where the patron reaches the Count Limit and the game processor determines whether an award shall be offered or presented to the patron.

Figure 4A:
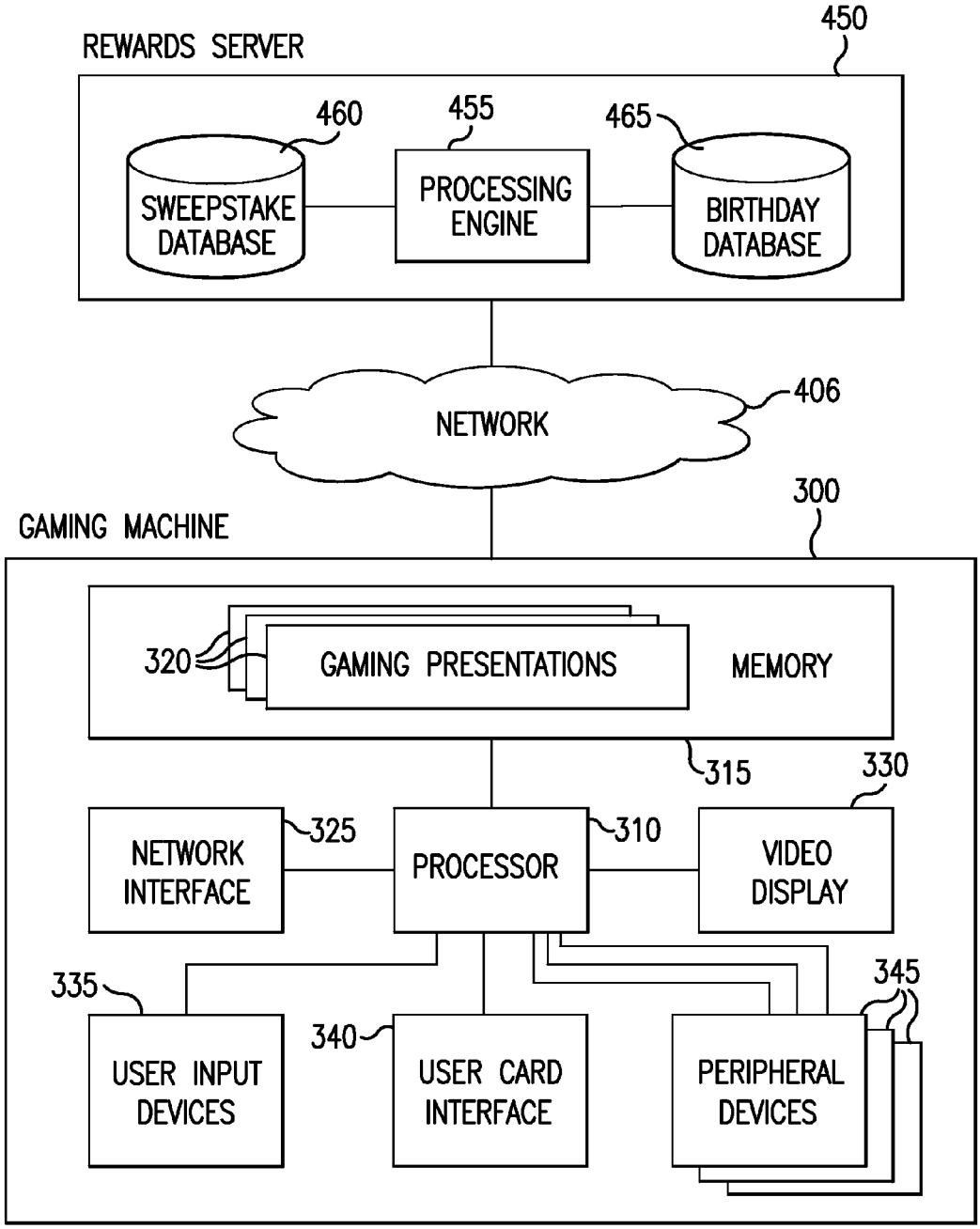
FIGS. 4A and 4B illustrates a simple block diagram of a rewards server connecting over a network to a representative example gaming machine in accordance with various embodiments.

Referring to FIG. 4A, a simple block diagram of rewards server 450 connecting over network 406 to representative example gaming machine 300 is shown. Example rewards server 450 includes processing engine 455 connected to sweepstakes database 460 and birthday database 465. Processing engine 455 may comprise a conventional personal computer, such as an Intel or AMD microprocessor-based computer, or, any other conventionally available computers capable of performing general purpose computing and gaming specific applications, such as Dell, Sun Microsystems or IBM computers. Databases 460, 465 may comprise one or more conventional hard drives or other storage media for storing patron records which may be written, updated, and accessed through processing engine 455, and, for storing programs executable by processing engine 455. The stored programs may include one or more procedures, subroutines, or sets of coding for performing or enabling birthday, sweepstake, or other player-centric rewards processing such as are outlined in the steps of FIGS. 1 and 2. For connecting the various devices, such as servers at the back-end and gaming machines 300 at the front end, network fabric 406 may include, but is not limited to, an IP-based local area network backbone, such as Ethernet. As may be appreciated, other functionally comparable network backbones may be utilized.

For instance, in an example system such as is shown in FIG. 4A, gaming machine 300 may utilize network interface 325 to connect with rewards server 450 through network 406. A player card connectable through user card interface 340 to gaming machine 300 may contain sufficient information which when read such as by user card interface 340 may be used to identify a player at gaming machine 300 either directly from the information stored on the card and/or by transmitting player card identification information to query a network-connected server and database containing player records such as rewards server 450 or a separate player tracking server (not shown) and accessing a patron's player records remotely. Once the patron's records have been accessed, a query may be sent to rewards server 450 either from gaming machine 300, a player tracking server, a host computer connected to various servers connected to the network, or other conventional network communicating device inquiring whether the patron is eligible to receive a birthday, sweepstake, or other player-centric reward. Responsive to the query, rewards server 450 may transmit a patron reward message to gaming machine 300 which may cause a message and/or video to be displayed for viewing by the patron on either an iView-type display, a main display, or other information medium, for example a speaker, apprising the patron of an available reward, possibility of a reward based on continued play, and/or providing an entertaining audio and/or video transmission.

In one example embodiment, the patron's player records including current Counts and/or Count Limits may be downloaded to gaming machine 300 from rewards server 450, a player tracking server (not shown), or some other networked computer and/or database. As the patron proceeds to play, the Count may be incremented or decremented as discussed more fully above until the Count either matches the Count Limit or reaches zero, at which point, the patron may become eligible for a player-centric award as discussed more fully above. As also discussed above, the patron's information may be utilized to compare against possible player-centric rewards, such as a birthday award, to determine the patron's eligibility. In another embodiment, the Counts and/or Count Limits may be maintained and updated on a server, such that as a patron plays, information is sent to the server concerning each play and the Count is incremented or decremented in accordance with a procedure such as is shown and discussed more fully above with reference to FIG. 1.

In the case of a network-connected player database and/or server accessible by one or more gaming machines 300 as through network interface 325 over network 406, an operator may identify and rate players, either through direct data input or conventional software designed to perform the identification and rating functions on a host computer or player tracking server based upon play over a period of time. Based upon the player rating, a procedure may be implemented as with a computer module executed by rewards server processing engine 455 that associates ratings of players with operator determined tiered player levels and according to the tiered player levels establishes eligibility for player-centric rewards as discussed above. The eligibility information may by example be stored according to player tier levels in sweepstakes database 460 and/or birthday database 465, or on an individual player basis, in a player tracking database which may be updated either in real-time or on a periodic basis through the player tracking server. When a player inserts a player card or otherwise identifies themself, a gaming machine may access and utilize the information stored on the networked system to determine the eligibility of a player for player-centric rewards. In the case where the player-centric rewards program resides on the gaming machine, then it may begin execution upon determining that the player at the gaming machine is eligible.

Alternatively, the player-centric rewards program may reside on a server, such as rewards server 450, remote from gaming machine 300. In which case, gaming machine 300 may simply provide the incrementing and comparison functions, and transmit a message to the server when the threshold is met for an award to be offered to a patron. For instance, when a player is identified at a gaming machine as eligible for player-centric rewards, then the player-centric rewards program may begin executing such as through processing engine 455. The instruction set may include sending a message to the gaming machine to set and increment a counter in accordance with play by the eligible player and to send a message to the server, for example, when the Count reaches the Count Limit.

In another alternative, the gaming machine may provide game play information on a real-time basis to the server which may perform the incrementing and comparison functions, as well as the rewards processing. Upon the server determining an award to be offered, the server may create and store a record which may be associated with the patron's player information and may also send a message to the gaming machine to notify a patron of the award offer. In the case of an award offer, a patron may be required to indicate an acceptance as by pressing an 'accept' button or key or by entering a personal identification number (PIN). Alternatively, in each case discussed above, an award may simply be given to a patron without any acceptance required by the patron. Conditions may or may not be included with an award or award offer, such as that the patron utilize or redeem the award within a period of time which may be determined by an operator.

Continuing to refer to FIG. 4A, in one or more embodiments, user input devices 335 may include a processor, memory, and associated components as may be implemented on a printed circuit board and the Count or Count Limit may be received by this circuitry and related software for decrementing or incrementing as the case may be upon each play by the patron. In these example implementations, the wager information may be passed from microprocessor 310 or another processor with access to wagering information, in accordance with an instruction from the processor in order that the Count or Count Limit be correctly adjusted.

In one or more example embodiments, a game monitoring processor unit, such as a Bally game monitoring unit (GMU), may be implemented separate from microprocessor 310 and the processor that may be included with user input devices 335, such as Bally's iView, but may be connected to both for receipt of gaming information and player information, respectively. In these example implementations, the Count or Count Limit may be maintained with the game monitoring processor unit and the wager information will be passed to it from or in accordance with an instruction from microprocessor 310.

In each of the examples described above, the Count or Count Limit may be incremented or decremented by a gaming and/or one or more related processors incorporating programming to effect steps, such as in accordance with the flowchart described by example with respect to FIG. 1. When the pre-determined number of plays is reached by the patron then a signal may be sent to display 339 (FIG. 3B) (incorporated with user input devices 335) and a celebratory show may be presented to the patron from a memory (which may be part of user input devices 335 or otherwise stored on gaming machine 300) to apprise the patron that the patron is eligible for an award. In the case, where gaming machine 300 is not network connected, then a random number generating program may be initiated to determine whether or what award the patron may receive, such as a sweepstakes prize, cash award, restricted credits, etc. In each of the cases described above with respect to player-centric rewards based on play, a similar program process or subroutine may be executed, such as in accordance with the flowchart described by example with respect to FIG. 2, which includes obtaining player information, such as birthday, anniversary, etc., and comparing against the current date or the program steps may simply obtain the date and compare versus selected stored holidays to determine whether a patron may be eligible for a player-centric award other than for play.

Continuing to refer to FIG. 4A, rewards server 450 includes processing engine 455 which may communicatively connect to sweepstake database 460 and birthday database 465. As shown, gaming machine 300 may include network interface 325, such as one or more conventional network PCMCIA cards or a Bally ACSC NT-board, GMU, or GTM, to facilitate IP-based or address-based communication of some form with other networked devices, such as the rewards server 450 and the like. Through the network, microprocessor 310 may communicate with rewards server 450 to facilitate execution of various rewards transactions. In one or more embodiments, the network interface 325 may be used to download one or more gaming presentations or other software and/or data from the gaming server. To facilitate placement of wagers using a credit or debit card through a credit card reader (not shown) that may be connected to gaming machine 300 as by example through user input devices 335, user card interface 340, and/or peripheral devices 345, network interface 325 may be used to communicate with a banking server (not depicted), which connects to a financial institution that has issued the financial card, conduct a credit card authentication process, and then credit the requested amount to gaming machine 300. The accounting server issues credit confirmation to gaming machine 300, which in turn allows the casino patron to place the desired wager on the machine and to proceed with the game. In a progressive gaming network environment, where several gaming machines 300 compete for a single jackpot prize, the network interface 325 may be used to communicate with other gaming machines 300, as well as with a game monitoring server (not depicted) to synchronize a jackpot value and other parameters.

Figure 4B:
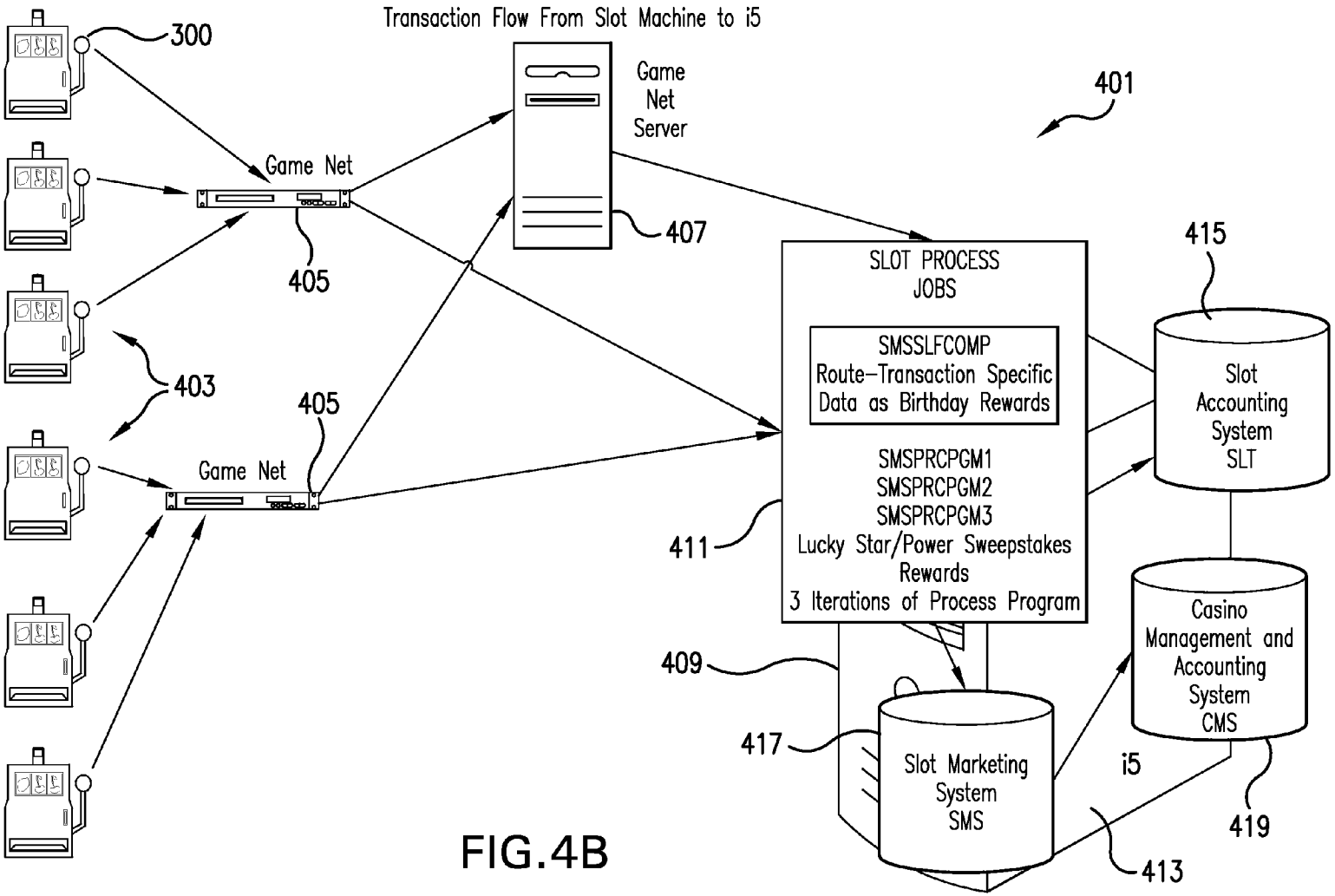

Referring to FIG. 4B, networked gaming system 401 is shown in accordance with one or more aspects of the invention wherein banks 403 of gaming machines 300 are connected to router 405, router 405 connects to router server 407 and multiple backend subsystems 409 including player-centric rewards programming enabling the executing of slot process jobs 411. By example, networked gaming system 401 may be conventionally architected such as with conventional Bally gaming machines and a conventionally available ACSC SMS and CMS products implemented with the IBM iSeries products with modifications to selected portions of the player tracking software to incorporate the player-centric rewards such as those described in FIGS. 1 and 2 and in the foregoing description.

Routers 405, such as a conventionally available Bally ACSC Game Net device, may be programmed to consolidate gaming data and other communications from respective bank 403 of gaming machines 300 into packets and to transmit the packets according to the routers programming to game net server 407 and/or pre-determined portions of multiple backend systems 409. Routers 405 may receive a notification of each transaction at their respective banks 403, modify the information prior to transmission to router server 407, such as a conventionally available Bally ACSC Game Net server, and selected portions of multiple backend subsystems 409 according to router 405 programming. For example, when a patron inserts the patron's card in a card reader of gaming machine 300, the information is read from the player card and transmitted to router 405 which in turn sends the player information to selected portions of multiple backend subsystems 409 and a query may be made whether the patron is eligible for a player-centric reward, such as a birthday reward. Additionally, upon a patron playing sufficiently to match the patron's Count with the Count Limit, router 405 connected to the respective player's gaming machine 300 may be programmed to transmit a message to a rewards server, such as shown in FIG. 4A, which may be implemented as part of multiple backend subsystems 409.

Multiple backend systems 409, such as may be conventionally architected using Bally's ACSC SMS and CMS iSeries-based products, may be programmed to process player-centric slot process jobs 411. The iSeries-based products implemented in the Bally architecture may include i5 server 413, which are originally manufactured by IBM and programmed by Bally to perform networked gaming systems functions. Amongst the programming that may be implemented may be player-centric rewards programming to perform the steps described in the figures and description herein. To accomplish various networked gaming systems functions including player-centric rewards processing, multiple backend systems 409 may include slot accounting system (SLT) 415, slot marketing system (SMS) 417, and casino management and accounting system (CMS) 419. Each of the respective systems may be under the centralized control of a host computer the function of which may be performed by i5 server 413. Additionally the respective functions of systems 415, 417, 419 may be implemented through programming of separate servers or a single server such i5 server 413. A workstation (not shown) may connect to i5 server 413 and may include a conventional display, keyboard, and mouse enabling an operator (user) to run respective programs associated with systems 415, 417, 419 and modify the operation of the respective systems through the selection of various options such as player-centric rewards criteria. For example, upon a patron inserting a player card into a gaming machine 300 connected to networked gaming system 401, a message may be sent to i5 server 413 that contains patron information and initiates one or more slot process jobs 411 according to the programming of i5 server 413 to determine whether the patron is eligible for a birthday reward. Programming of i5 series 413 may be triggered upon receipt of the patron information that includes sending selected patron information and a query to slot marketing system 417. In parallel, i5 series 413 may send patron and gaming machine 300 identifying information and a transaction report to slot accounting system 415. On determination of a patron's eligibility for a birthday reward, SMS 417 may send a message to CMS 419 to make a record of the transaction and a message may also be sent from multiple backend systems 409 to gaming machine 300 notifying the patron of the birthday reward. Similarly, slot process jobs 411 may be initiated on i5 series 413 upon a patron meeting the playing criteria for eligibility for one or more player-centric rewards, such as Bally Lucky Star Power Sweepstakes Rewards.

Figure 5:
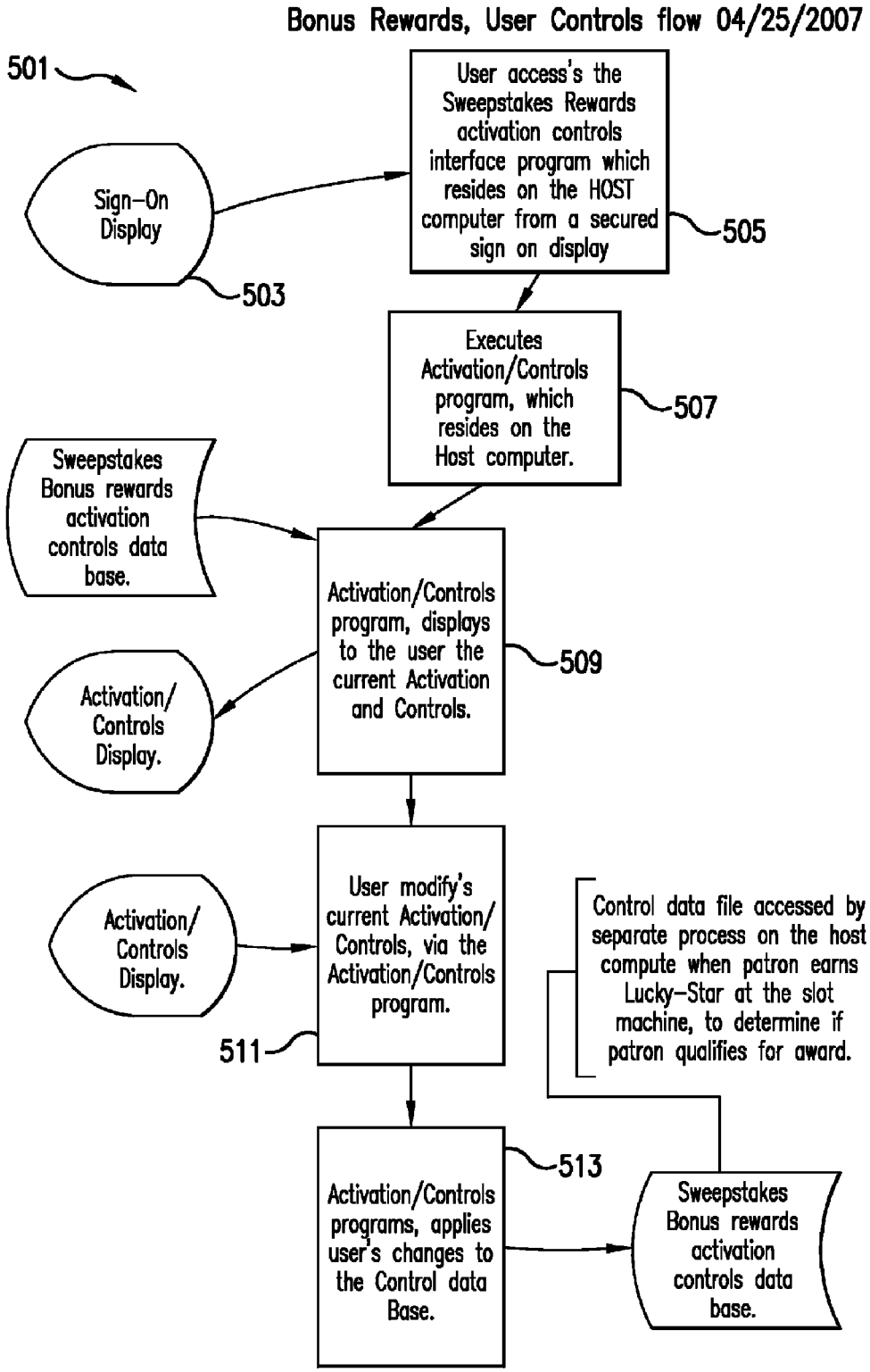
FIG. 5 illustrates an example bonus rewards control process flow diagram in accordance with various embodiments.

Referring to FIG. 5, bonus rewards control process 501 is shown via a flow diagram in accordance with one or more aspects of the invention and describes process steps which may be implemented by the programming and running of a bonus rewards program on i5 server 413 and programming various options through the user workstation, such as a Bally Control Panel (BCP). In order to access information or initiate programming activity at the workstation, i5 server 413 includes conventional security programming that upon a key being depressed on the keyboard presents a query on the display requesting a user to log in a user identification and password (step 503). Once an authorized user has been identified by i5 server 413, a menu may be displayed with various options for the user to choose from. Amongst the options, one option may be to access the Sweepstakes Rewards activation controls interface program residing on i5 server 413 which user activates (step 505). Upon receiving the activation request, i5 server 413 executes the Sweepstakes Rewards activation controls program (step 507), accesses the Sweepstakes Rewards activation control database where the current settings are stored and displays the current settings (step 509). Once the current settings are displayed, the user can modify various of the settings by typing values or pulling down a menu of options associated with the various settings (step 511). When the user has completed modifications to the Sweepstakes Rewards settings, the user may press the enter button which may cause the Sweepstakes Rewards activation controls interface program to receive the input data and instruct i5 server 413 to over-write the old current settings data with the new current settings data in the Sweepstakes Rewards activation control database. Prior to over-writing the old data, i5 server 413 may respond with a security question asking if the user is sure that it wants to change the current settings. Upon the user, pressing the 'ok' button, i5 server 413 over-writes the old data with the new data, (step 513). Thereafter, when a patron qualifies for a Sweepstakes Reward, a message is sent from gaming machine 300 to i5 server 413 which causes the Sweepstakes Reward program to be executed and the Sweepstakes Reward control data to be accessed from the Sweepstakes Reward activation control database to determine the eligibility of the patron for one or more Sweepstakes Rewards.

Figure 6:
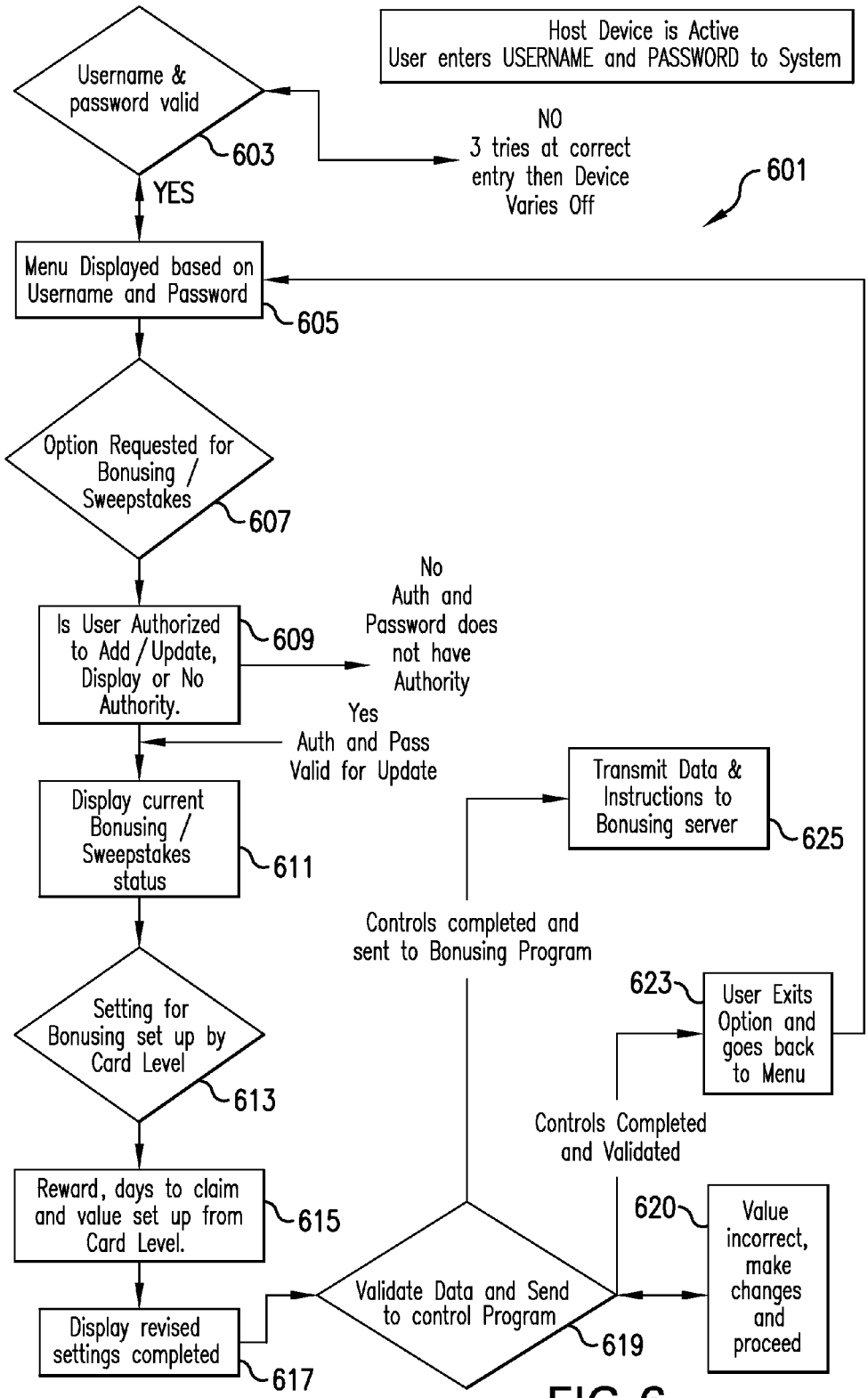
FIG. 6 is an example bonus rewards control process flow diagram in accordance with various embodiments.

Referring to FIG. 6, bonus rewards control process 601 is shown via a flow diagram in accordance with one or more aspects of the invention and describes process steps which may be implemented by the programming and running of a bonus rewards program on i5 server 413 and programming various options through the user workstation. Bonus rewards control process 601 describes additional steps and options as compared to process 501 shown in FIG. 5; however, the programming and operation is similar in both instances.

To initiate activity at the workstation, the workstation display panel may display a request for a username and password, (step 603). When the workstation user enters a username and password and transmits the information, the workstation or the i5 server 413 or some other network connected device may compare the entered user information with a database to determine if the user information matches an authorized user. If the user is authorized to enter the bonus reward control application maintained by i5 server 413, the workstation, or another network connected device, then a menu may be displayed (step 605) based on the level of access permitted to the user which may be determined by the information stored in the database and associated with the username. As a security measure, security programming may cause i5 server 413 to lock the keyboard and/or display in the event that an incorrect username and password is entered three times.

Amongst the selections provided by the display may be Bonusing/Sweepstakes (step 607) which the user may choose to select. The computer application controlling access to this option may determine whether the user is authorized to modify, add, or update, or view the Bonusing/Sweepstakes status menu (step 609).

If the user is not authorized, then a message may be displayed accordingly and an alert message may be sent to a security computer and/or monitor indicating that there has been an attempt to access the Bonusing/Sweepstakes status menu by an unauthorized user. If the user is authorized, then the current Bonusing/Sweepstakes status for the CMS & SMS may be displayed on the display panel (step 611). Depending upon the user's access level, portions of the displayed settings for Bonusing/Sweepstakes may be set for read-only while other portions may be selectable and modifiable. Alternatively, portions of the display settings which might otherwise be read-only may be provisionally allowed to be reset subject to a sign-off by a user with higher level authorization.

One way to begin adjusting Bonusing/Sweepstakes settings may be to select a player card level, (step 613). In accordance with the player card level, the user may select a reward from a set of allowable rewards, set the number of days to claim the reward, and set a value for the reward. Where, for example, the value may be a dollar amount which may correspond to a Count Limit to be associated with the player card level according to denominations played by the various patrons, (step 615). Upon entry of the new settings, the display panel may show the revised settings along with the unrevised settings, (step 617). The user may repeat the steps for each player card level or the user may have the opportunity to revise each card level before entering the changes.

Once the user has entered the changes, the bonus rewards processing requests the system to validate the entered data changes. The validation may be at the local level (the workstation) or may be performed by i5 server 413 or may be performed by some other network connected device depending upon which device executes the bonus rewards editing program. During the validation processing, the bonus rewards editing program may compare the settings against a local database containing permissible settings according to levels of players. In the event that a discrepancy is found, then the display panel may indicate the error and request a correction before proceeding, (step 620). Once the new data settings are validated at the local level, the workstation or i5 server 413 may transmit the new Bonusing/Sweepstakes data settings to rewards server 450 with an instruction to update the previous settings. The user may exit the Bonusing/Sweepstakes editing process and return to the main menu, (step 623).

Figure 7:
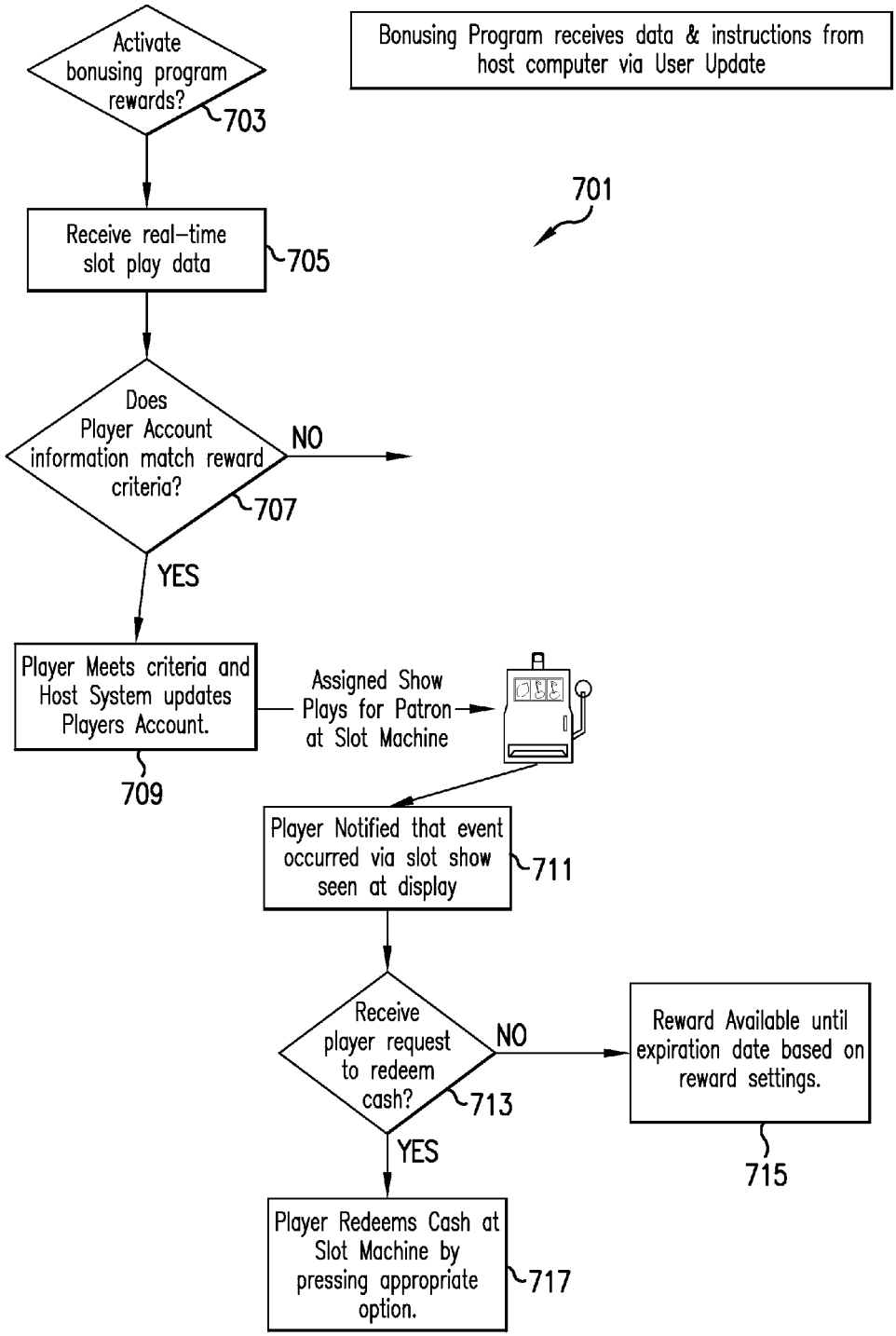
FIG. 7 is an example flowchart of a bonusing rewards process in accordance with various embodiments.

Referring to FIG. 7, a flowchart shows a bonusing rewards process 701 in accordance with one or more embodiments of the invention. In the instant flowchart, the user updates from FIG. 6 process have been input to rewards server 450. As discussed earlier, in an alternative embodiment, the rewards program may be loaded on gaming machine 300 with the player information being either included in a local or remote database accessible by the gaming machine processor in order to determine eligibility, etc.

After a patron inserts his/her player card, a query may be made from the gaming machine as to whether the bonusing rewards program is active, (step 703), and in the case of a server based rewards program, the real-time play data may be transmitted to rewards server 450, (step 705). It may be appreciated that that would be one of many types of ways to process the player information so as to be able to determine eligibility, rewards, etc. If the bonusing rewards program is active then rewards server 450 may access and process the player information to determine whether the patron's account information matches any of the rewards criteria, (step 707). If not, then the rewards processing with respect to the particular patron terminates or the rewards server 450 continues to receive updates on the patron's play, if a reward process is active based on Count and for which the patron may be eligible in the event of additional play. If the patron information does match the rewards criteria, then the patron's account is updated accordingly, (step 709). Rewards server 450 or the host computer sends an instruction to gaming machine 300 to play a show for the patron on one of the gaming machine displays and/or an associated overhead display and the patron is informed through the show and/or additional information of the reward, (step 711). In the case where the patron is required to take an action to accept the reward, patron may do so through the player interface associated with the gaming machine or may go to a cage to request the reward, (step 713). In the case where the reward has a time-limitation for redemption, the patron may be informed that the reward will expire at a pre-determined time, such as at the end of the day or week, etc., (step 715). Upon seeing the show, patron may simply choose to redeem the reward, such as a cash reward, by pressing the accept button to download credits to gaming machine 300, (step 717). Upon redemption of a reward, rewards server 450 and/or player tracking server receives the information and the patron's account is updated accordingly.

Figure 8:
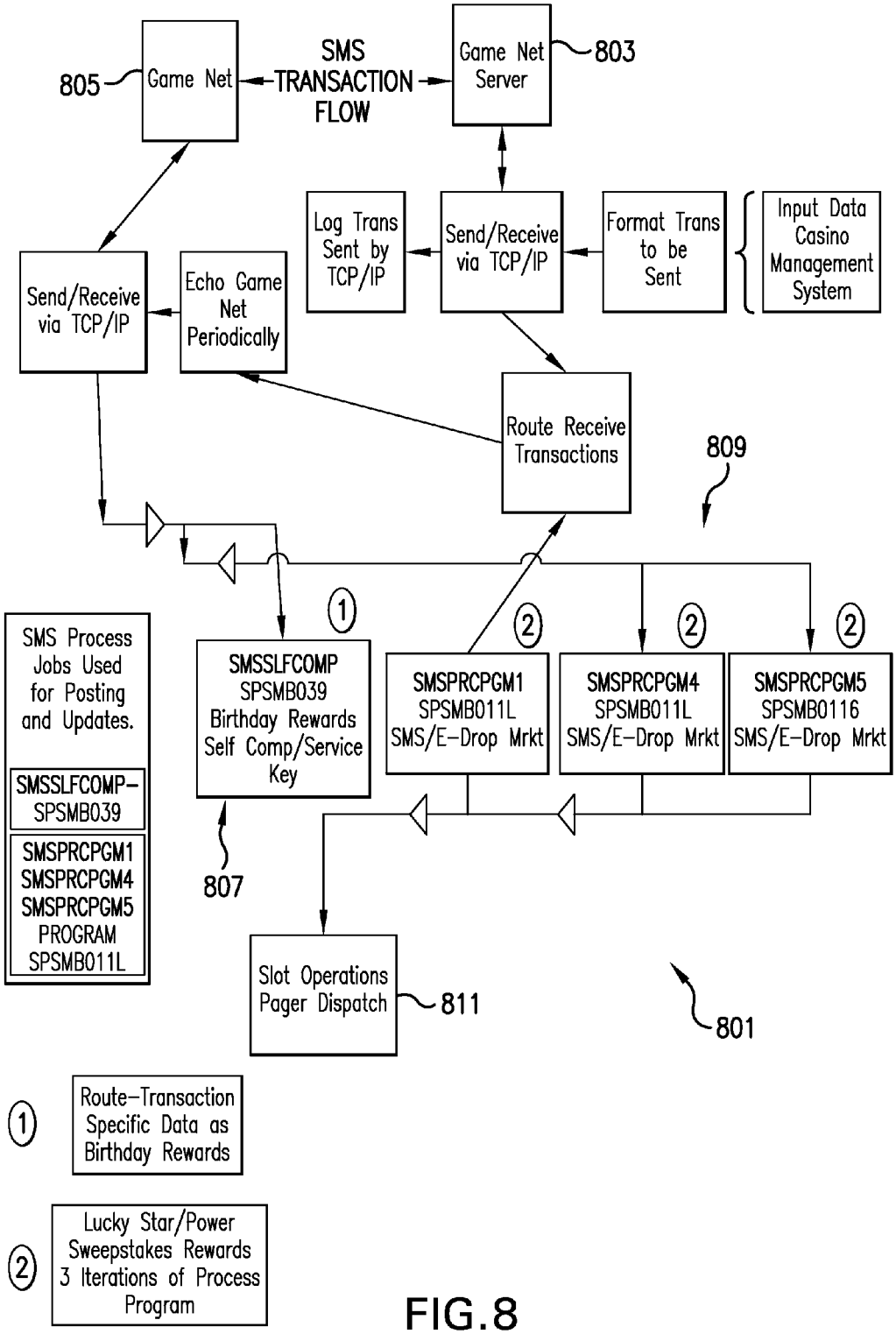
FIGS. 8 and 8A are example SMS block diagrams including transaction flow in accordance with various embodiments.
Figure 8A:
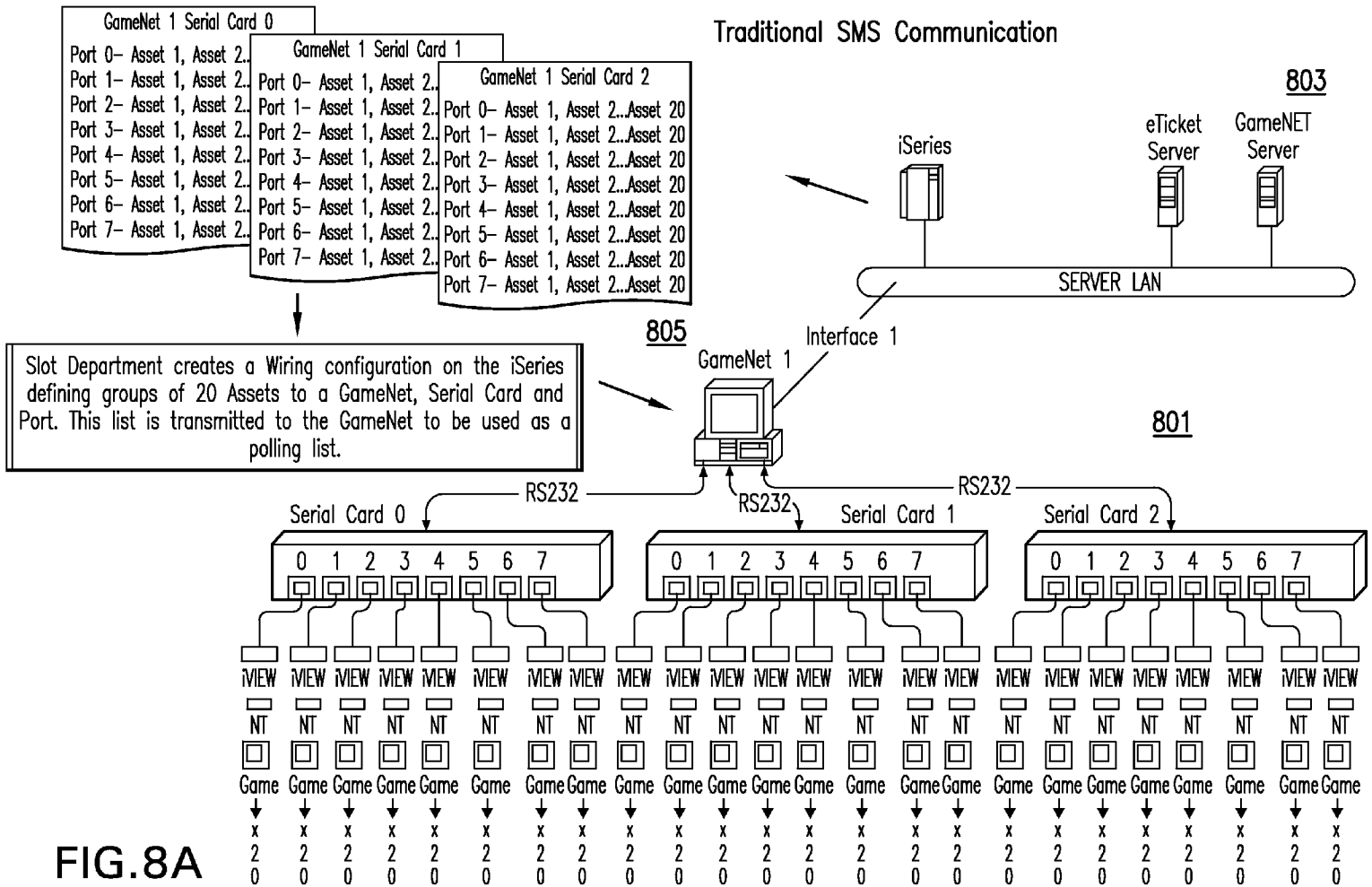

Referring to FIGS. 8 and 8A, SMS block diagrams including transaction flow 801 are shown in accordance with one or more embodiments of the present invention. Game server 803, such as a Bally Game Net server, may execute rewards program and communicate through floor processor 805, such as Bally Game Net, to provide player-centric rewards at the gaming machines. Through floor processor 805, birthday rewards messages 807 are transmitted to respective gaming machines 300. Birthday rewards messages 807 cause keys to be activated on gaming machine 300, such as self-comp/service keys, so that patrons may accept and pull-down cash rewards or playing credits, etc. down to their respective gaming machines.

In order to determine patron eligibility, rewards server 803 may receive data from the CMS, such as patron account information. Also, the player account information may be updated to the CMS as part of the processing performed through floor processor 805 and game server 803 when patrons are awarded and redeem rewards. Transmissions may be made as between the networked devices using TCP/IP protocols.

In one or more embodiments, three player levels 809 are utilized (although there may be more or less depending upon the users selected options) and the respective Count Limits and related reward information are transmitted as between floor processor 803 and the respective gaming machines where eligible patrons play. Upon notification if rewards, floor personnel may also be apprised as through pager dispatch 811.

Figure 9:
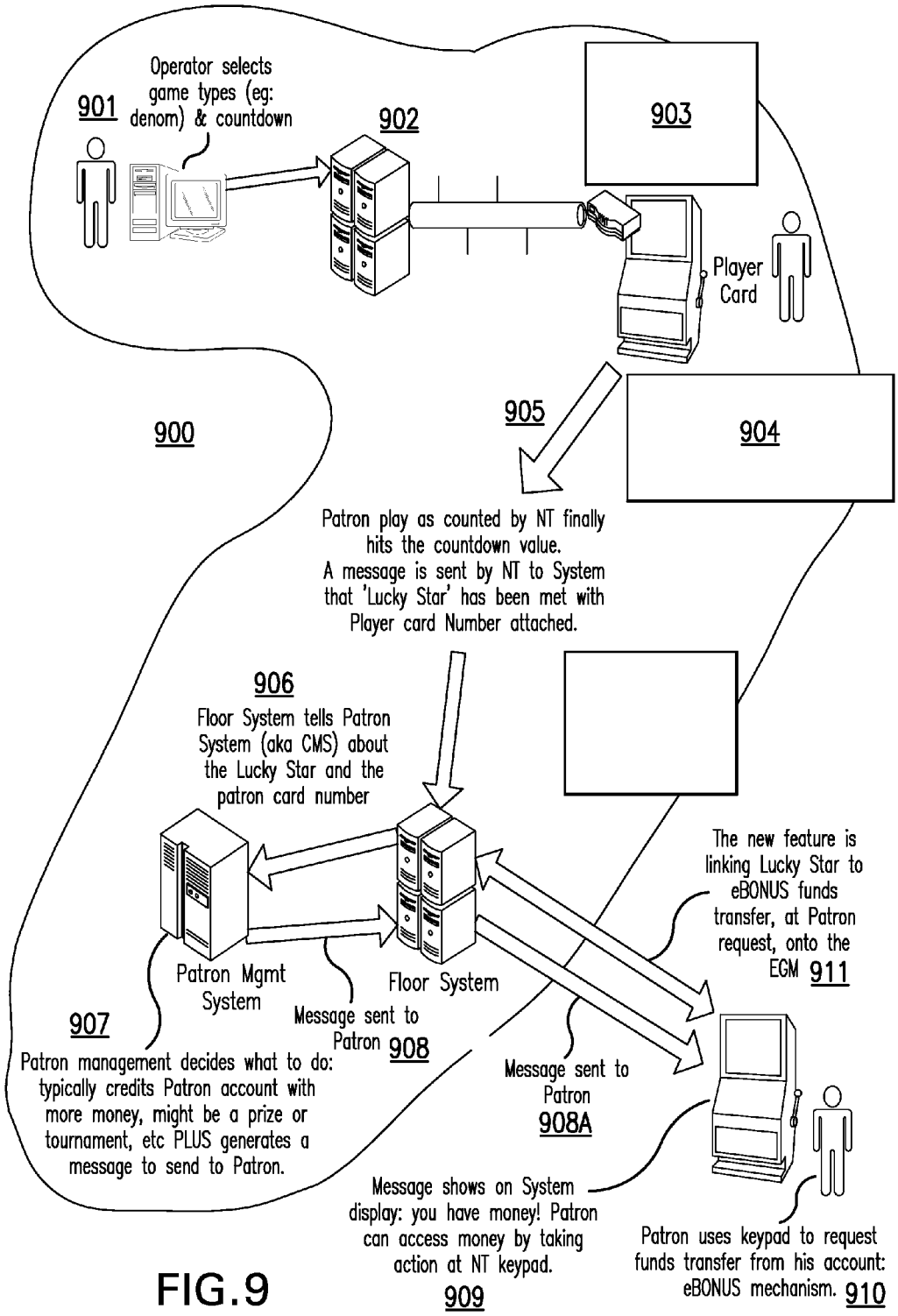
FIG. 9 is an example flow diagram of a player-centric rewards system in accordance with various embodiments.

Referring to FIG. 9, a flow diagram of player-centric rewards system 900 in accordance with one or more aspects of the invention. To initialize the player-centric rewards, an operator or user inputs the rewards process data at the workstation 901 connecting to bonus rewards server 902. As described previously, the operator may select from various input values, which may include the denomination and corresponding Count Limit required to be played by a player before the player may be eligible for a reward, such as a Bally Lucky Star. The input data is transmitted to bonus rewards server 902 which in turn communicates through the network 903 with gaming machines 904. When the player inserts a player card into a card reader associated with a player interface unit, gaming machine 904 sends the information to the host computer which routes the information through its network of processors and processes to determine the patron information and query bonus rewards server 902 as to the patron's eligibility. To enable the communication between the player interface unit, a player interface processor includes an executable communication instruction set operable to receive and transfer information between the player interface and the rewards server. The player interface processor may be connected to communicate directly over the network or through other processors, such as a game processor associated with the gaming machine or a network processor, such as the processor controlling a Bally GMU or GTM, which may communicatively connect with the player interface unit, such as a Bally iView, the game processor, and the rewards server.

Bonus rewards server 902 may determine if there is an immediate reward available, such as a birthday reward, and also determine whether the patron is eligible to play for player rewards and if so, may determine the Count Limit required based on the player rating or may obtain a current Count state, if the system permits accumulation of the Count during more than one playing session. The Count and Count Limit may then be transmitted to gaming machine 904, where in the case of an ACSC CMS/SMS an NT board at the gaming machine may store the Count Limit and current Count. As the patron plays, the Count may be accumulated by a counter associated with the NT board. When the Count matches the Count Limit, a message may be sent from gaming machine 904 to floor processor 906 which in turn may transmit the information to patron management system 907, such as the CMS including rewards server 902, which may include the patron's identifying information and that the patron has met the play requirements for a reward, such as a Lucky Star. Patron management system 907 processes the information and based on the preprogrammed rewards and eligibility data determines the award to be offered to the patron, updates the patron's account to include the award information, and transmits message 908 to the patron through floor processor 906 and gaming machine 904 which may cause a show to be initiated on display 909 on gaming machine 904 that informs the patron of the award. Thereupon, the patron may use keypad 910 on gaming machine 904 initiate request 911 for the award to be downloaded from the patron's account and onto the credit meter of the gaming machine (in the case of a cash award). Request 911 is transmitted through floor processor 906 and to patron management system 907 where the processing system determines whether the request should be granted and takes the actions needed to comply if the request is valid.

Referring to FIG. 10-23, screen captures of display menus are shown which may be generated at a user interface, such as a workstation connected to a host computer and/or rewards server in accordance with one or more aspects of the invention. The user interface menus shown may be accessed by a casino operator's agent at a host computer and/or related servers' user interface. The menu illustrates a data structure that may be stored and implemented in the processing engine 455 of the rewards server 450 to effectuate processing of the sweepstakes and/or birthday rewards transactions according to one or more exemplary embodiments.

An example workstation may be a Bally control panel which includes a display and keypad for use as a user interface. Authorized personnel may access the work station by entering their username and password. Depending upon the level of security access permitted by the user, the user may be able to access menus which are generated from a rewards program providing for editing.

The menu of FIG. 10 provides a user information as to the status of the rewards program on the CMS. In this example, the Bally Power Sweepstakes Rewards program is active, so that an eligible patron may accumulate a Count during the patron's gaming session or sessions and when the Count matches the Count Limit, the patron may obtain a reward, such as a sweepstakes entry. There may be multiple winners of the sweepstakes which may be determined real-time and there may be varying levels of prizes or rewards which may be obtained depending upon the sweepstakes entry. In the menu of FIG. 10, the user is offered the option to activate controls, maintain the rewards program, exit the rewards program, or continue to another menu.

The menu of FIG. 11 presents a query to the user as to whether the rewards program is active on the CMS. In this instance the rewards program is currently active.

Figure 12:
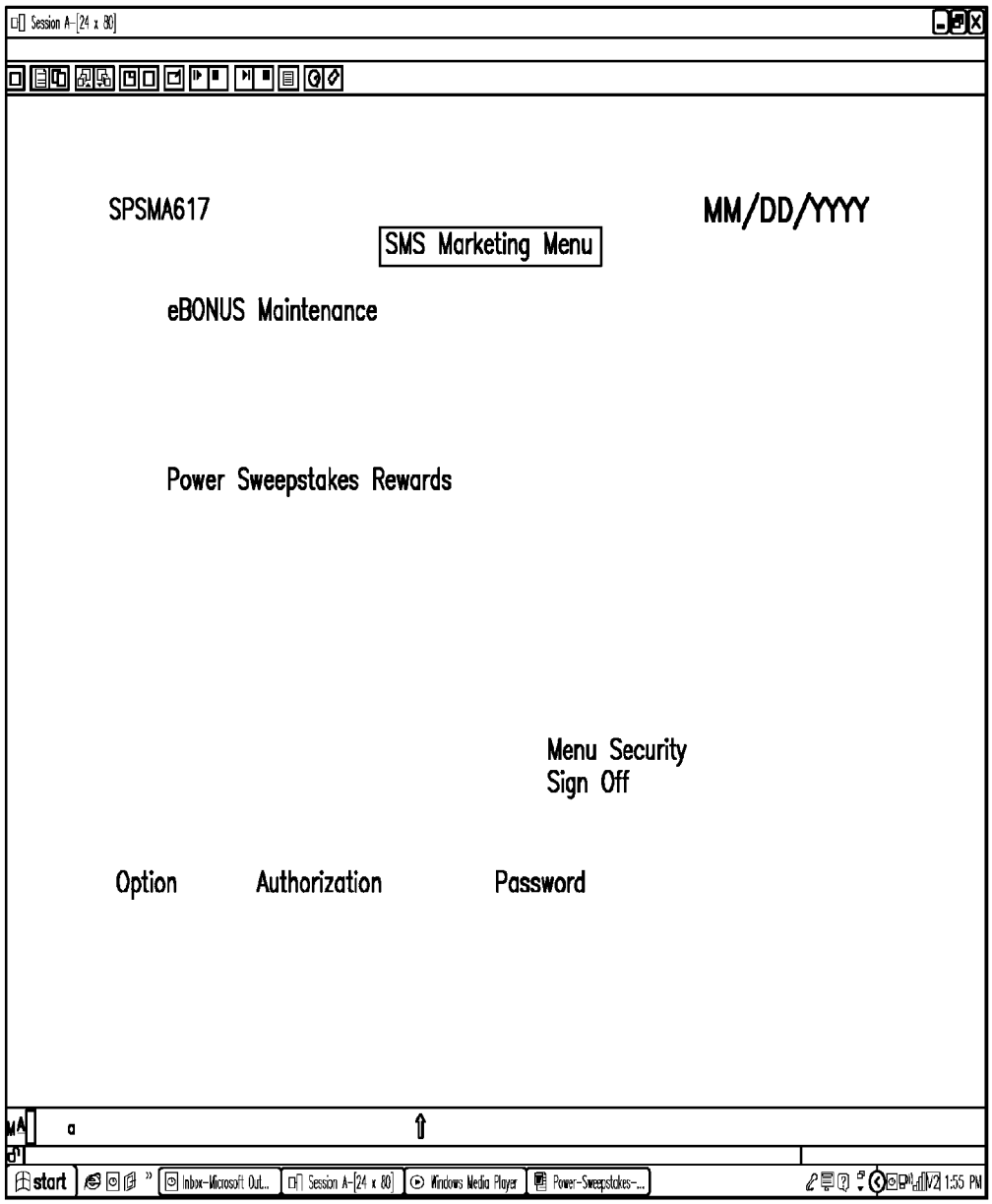

The menu of FIG. 12 is entitled SMS Marketing Menu which provides options for the user to select one of the marketing programs available on the CMS/SMS which in this instance include options to select either eBonus Maintenance or Power Sweepstakes Rewards. Additional options may be requested, the user may sign off, or may enter a required password for access at different levels of authorization.

Figure 13:
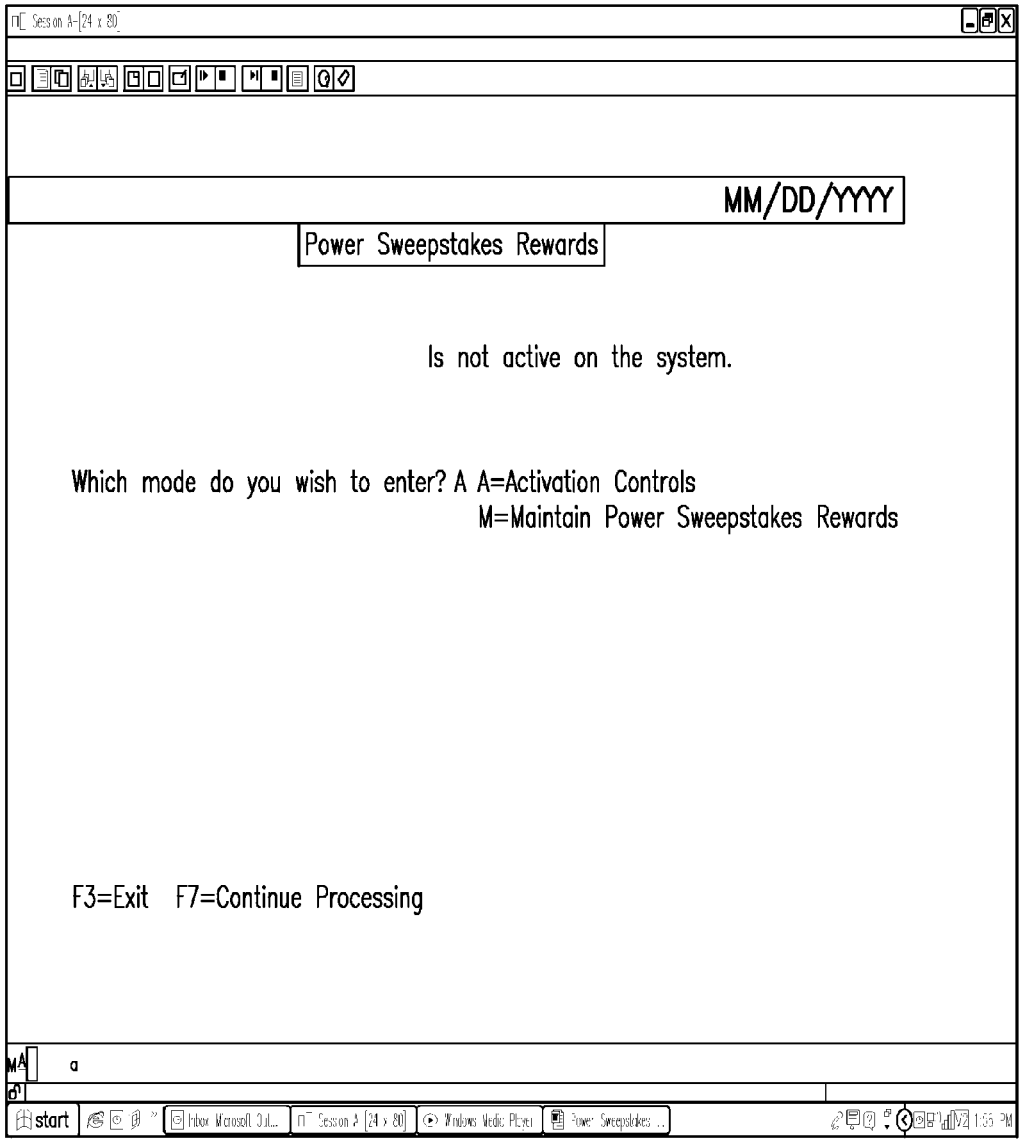

The menu of FIG. 13 informs the user that the sweepstakes rewards program is not active and the provides a query asking the user if the user wishes to enter the activation controls or maintain sweepstakes rewards menu.

Figure 14:
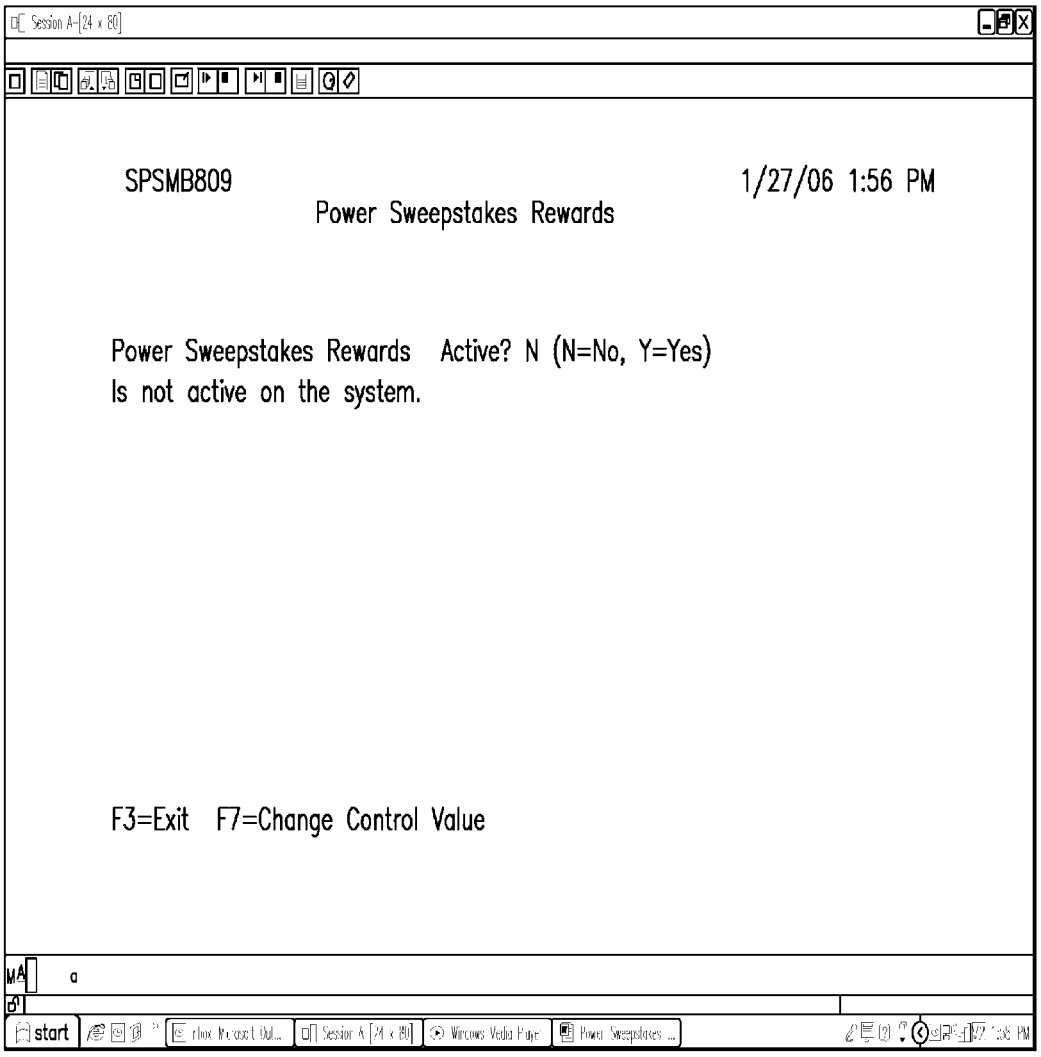

The menu of FIG. 14 presents a query whether the rewards program is active on the CMS. In this instance, the rewards program is not active.

The menu of FIG. 15 presents a columnar listing of the respective denominations of slot machines and sweepstakes rewards eligibility for three levels of patrons. In one or more exemplary embodiments, the processing engine 455 may be configured to recognize the three different card levels. The gaming machines 300 may have different slot denominations ranging from $0.01 to $100 (Column 1). As shown, a user may select different rewards and redemption period for each denomination and each level of player. For instance, from the example menu, it may be seen that the user has designated that the highest level players are eligible to receive a sweepstakes reward of $15 (Column 2) which is redeemable for a period of 15 days (Column 3) for playing any denomination slot machine.

On gaming machines having $0.01, $0.02 and $0.05 cent slot denominations or wagers per line played by a patron, only the highest designated card level is eligible to receive the sweepstakes reward of $15 which is available for a period of 15 days from activation of the sweepstakes reward. Zeros in Columns 3 and 4 indicate the ineligibility of the second level patrons and zeros in Columns 4 and 5 indicate the ineligibility of the third level patrons.

On gaming machines having a $0.10 denomination, only the first and second card levels may receive the sweepstakes rewards. For $0.10 denomination slot machines, the first card level patrons are eligible to receive a $15 reward available for 15 days, and the second card level patrons are eligible to receive a $10 reward available for 10 days.

For gaming machines having a $0.20 to $100 slot denomination, the first card level patrons are eligible to receive a $15 reward available for 15 days, the second card level patrons are eligible to receive a $10 reward available for 10 days, and the third card level patrons are eligible to receive a $5 reward available for 5 days. As discussed previously, in order for patrons to receive a reward, pre-determined amounts of wagers are played by the patrons and the amount of wagering required to obtain a reward may be varied according to the player level. The menu through the rewards program provides the user the opportunity to change any of the displayed values, delete any of the denomination rows, and display any updates.

In accordance with one or more embodiments, the sweepstakes rewards may become available to a casino patron as soon as the rewards are activated by the casino. In one or more embodiments, the sweepstakes rewards are available only to the casino patrons who have casino-issued user cards. Therefore, to access the sweepstakes rewards, the patron must insert his or her user card into the gaming machine 300. If the sweepstakes rewards are available, the patron is notified of the available sweepstakes rewards. In one or more embodiments, a 'promo' light on the gaming machine 300 may blink as an indicator that one or more rewards is available. In another embodiment, a message may be displayed on the iView™ interface describing the sweepstakes rewards that are available. A patron may accept the reward credits by pressing a 'Rewards Button' on the gaming machine 300 at the time of receiving the notification or at any other time within the indicated promotional period at any gaming machine 300 within the gaming environment. Once the patron redeems the sweepstakes reward, the rewards notification message is no longer displayed to the patron on the gaming machines 300. The rewards server 450 may maintain information about patrons who have redeemed their sweepstakes rewards in the sweepstakes rewards database 460.

Similar to the sweepstakes rewards, the rewards system may also provides birthday rewards to the casino patrons according to one or more embodiments which may be modified using a menu similar to that shown in FIG. 15. Processing engine 455 of rewards server 450 may be configured to implement birthday reward transactions. The birthday reward is typically made available to the casino patrons only once a year and may be cashed out only within a predetermined time period before or after the patron's birthday. The time frame for redeeming birthday rewards may be set based upon the card level of the casino patron. The birthday information relating to the casino patron may be stored in the birthday rewards database 465. The birthday rewards information in the database 465 may be accessed based upon the patron's user ID information, which is read from the user's card and then provided to the rewards server 450 by the gaming machine 300. To assure that the patron does not get multiple birthday rewards within any one year time period, the birthday rewards database 465 contains information on whether the given patron has redeemed his or her birthday reward.

Similar to the sweepstakes rewards, the birthday rewards amount and duration may depend on the card level of the particular casino patron. Thus, in one example, a first level card holder may receive a $15 birthday reward and have 15 days to take these credits once they become available to the patron, provided the patron inserts his user card into the gaming machine between three days before and three days after his birthday. The second level card holders may receive a $10 birthday reward and have 10 days to take these credits once they become available to the patron, provided he inserts his user card into the gaming machine between two days before and two days after his birthday. The third level card holders may receive a $5 birthday reward and have only five days to take these credits once they become available to the patron, provided he inserts his user card into the gaming machine between one day before and one day after his birthday.

The menu of FIG. 16 presents the one cent denomination Count Limit settings for the three respective levels of patrons. The rewards program also displays the maximum limit that may be entered '$65535' and provides instructions to the user to make changes and view additional settings or menus. In the example menu, only the highest level patron is eligible for receiving a $15 sweepstakes reward (Column 1), which may be redeemed within 15 days (Column 2). When a reward is to be offered, select a show that will be displayed for the patron (Column 3). The number '59' corresponds to a show stored on the rewards system. The second and third level patrons are not eligible for a reward for playing one cent denomination slots which is reflected by the zeros in row 2 (second level patron) and row 3 (third level patron). The user may modify any of the data and link the sweepstakes reward promotion to other rewards, bonuses, and/or promotions.

The menus of FIGS. 17 and 18 are informational pages that are generated by the rewards program to introduce the user to the sweepstakes reward program as implemented on the SMS/CMS.

The menu of FIG. 19 displays the Count Limit settings for five cent denomination slot machines and indicates that the number one rated patrons may be eligible after playing one hundred dollars of wagers. The menu also provides for the user to make changes and/or deletions to the settings which are also included with respect to gaming machine manufacturer.

Figure 20:
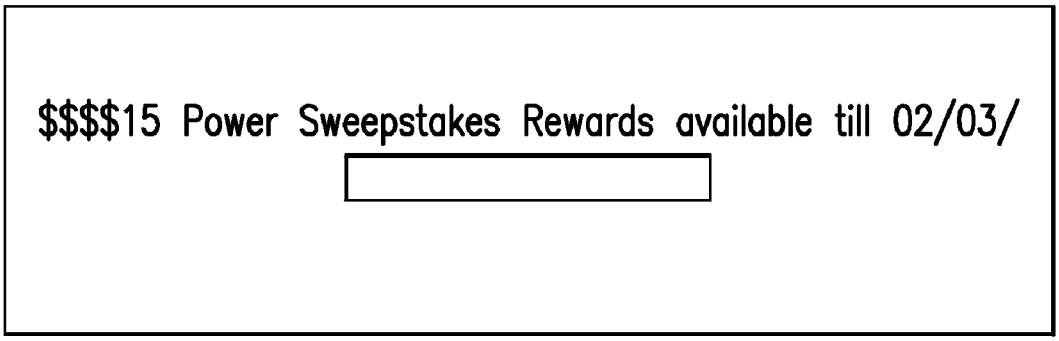

The menu of FIG. 20 provides a display of the message to be presented to a patron which may be modified by a user. When a patron earns a sweepstakes reward, the message may be displayed on a player interface, such as a Bally iView, on a gaming machine where the patron is playing. The display informs the patron that the patron has earned a $15 reward which must be redeemed by a set date.

The menu of FIG. 21 displays various subroutine/function code links (Column 2) associated with the rewards program and descriptions (Column 1) which may be identified by the user to adjust settings. For instance, each card level has a separate variable associated with the amount of the reward, the number of days to claim the reward, and the show to be provided when the patron earns a sweepstakes reward.

The menu of FIG. 22 displays the SMS system values which may be modified by a user. For instance, in the example, Lucky Stars Active refers to the sweepstakes rewards as described above and the 'Y' indicates that 'yes, Lucky Stars is active. The user may replace the 'Y' with a 'N' to de-activate the rewards being offered to patrons on the system. Other active and inactive features of the SMS system are shown on the display and may be modified by the user.

The menu of FIG. 23 displays a summary of sweepstakes rewards for which Card Level 1, 2, and 3 patrons are eligible that play on $0.25, $0.50, $1, and $5 denomination slot machines 300 or wager in those denominations on slot machines 300 with multiple denominations and/or amounts that may be wagered per line. The amount of the reward and the days that the reward will be available may be varied according to patron level and denomination wagered. More than one Count Limit may be maintained for an individual patron depending on the denomination played. The user may also select the particular rewards code to associate with the denomination, such as 'Ebonus1'.

While the example embodiments have been described with relation to a gaming environment, it will be appreciated that the above concepts can also be used in various non-gaming environments. For example, such rewards can be used in conjunction with purchasing products, e.g., gasoline or groceries, associated with vending machines, used with mobile devices or any other form of electronic communications. Accordingly, the disclosure should not be limited strictly to gaming.

The foregoing description, for purposes of explanation, uses specific nomenclature and formula to provide a thorough understanding of the invention. It should be apparent to those of skill in the art that the specific details are not required in order to practice the invention. The embodiments have been chosen and described to best explain the principles of the invention and its practical application, thereby enabling others of skill in the art to utilize the invention, and various embodiments with various modifications as are suited to the particular use contemplated. Thus, the foregoing disclosure is not intended to be exhaustive or to limit the invention to the precise forms disclosed, and those of skill in the art recognize that many modifications and variations are possible in view of the above teachings.

What is claimed is:

1. A method for providing an award to players of gaming machines comprising:

providing for storage at a server of (i) data corresponding to player reward criteria, said reward criteria including a count criteria having a count value for each player related to the gaming activity of the player and (ii) data corresponding to reward prizes of a first value for players of a first rating and a second value for players of a second rating;

enabling identification of a player at a gaming machine to determine the reward criteria, a first or second ranking for the identified player and reward prize value pertaining to said player;

configuring a controller to monitor the play of the gaming machine by the player and determine if said reward criteria has been satisfied and said player is eligible for a prize; and configuring said controller to reward a prize to a player upon determining that said player has satisfied said reward criteria said prize value based upon said player's ranking.

2. The method of claim 1 comprising providing for storage of data corresponding to reward prizes including one or more of sweepstakes rewards and birthday rewards.

3. The method of claim 2 comprising providing for storage of data corresponding to reward prizes including one or more cashable and non-cashable credits that can be used by the player to play the game.

4. The method of claim 3 comprising configuring said controller to determine the player's eligibility for the sweepstakes reward includes determining whether the player has wagered a predetermined number of credits at one or more of said gaming machines.

5. The method of claim 3, wherein the step of configuring said controller to determine that the player has satisfied said reward criteria includes configuring said controller for randomly determining the player's eligibility for such reward.

6. The method of claim 3, further comprising configuring said controller to determine an amount of the sweepstakes reward.

7. The method of claim 6 comprising providing for storage at said data structure data corresponding the sweepstakes award, wherein the amount of the sweepstakes reward is based upon on one or more of the denomination of the wagers, the frequency of the player's gaming, the duration of the player's gaming, and the amount wagered by the player during gaming.

8. The method of claim 3 comprising providing for storage of data corresponding to player birth dates and data corresponding to prizes of at least a first value and configuring said controller for determining that said player has satisfied said reward criteria for the birthday reward comprises configuring said controller for determining whether the player has requested birthday rewards within a predetermined time frame surrounding the player's birth date.

9. The method of claim 1 comprising providing for the storage at said data structure of data corresponding to one of said first and second values of the birthday reward based, at least in part, on one or more of the denomination of the player's wagers, the frequency of the player's gaming, the duration of player's gaming, and the aggregate amount wagered by the player during gaming.

10. The method of claim 1 comprising configuring said controller for notifying the player of availability of the player rewards.

11. The method of claim 1 comprising configuring said controller for notifying the player of eligibility for one or more of the player rewards.

12. The method of claim 1 comprising providing for storage at said data structure of player reward criteria including demographic information and said controller configured for using demographic information of the player to determine whether the player satisfies one or more of said criteria for receiving one of the player rewards.

13. The method of claim 1 comprising providing for the storage at said data structure player of reward criteria including player biographical information and configuring said controller for using biographical information of the player to determine whether the player satisfies one or more of said criteria for receiving one of the player rewards.

14. The method of claim 1 comprising providing for storage at said data structure data corresponding to using game play of the player to determine whether the player meets one or more criteria for receiving one of the player rewards, the player rewards being independent of any award including bonus award associated with a game play event.

15. The method of claim 1 comprising providing for storage at said data structure data corresponding to a sweepstakes reward and configuring said controller for randomly or quasi-randomly selecting the sweepstakes reward from a set of possible sweepstakes rewards.

16. The method of claim 1 comprising configuring said controller to determine the player eligibility including the steps of using the player rating to determine player eligibility for the one or more player rewards and if the player is determined eligible, then determining a count limit associable with an amount of game play based upon the player rating; configuring said controller for maintaining an incremented count based upon the game play and determining whether the player meets one or more criteria including determining whether the incrementing count matches the count limit.

17. The method of claim 1 comprising configuring said controller for identifying one or more additional eligible players, monitoring the play of the additional eligible players and determining whether the player meets one or more criteria including determining whether the player met the one or more criteria prior to the additional players; the player reward selecting step including determining the selected player reward based upon whether the player met the one or more criteria prior to the additional players.

18. A method for awarding prizes to players who play gaming machines linked through a casino management system which compiles and stores information about the players and monitors the gaming machines, said player information including, for each player, a rating level from a plurality of rating levels, the method comprising:

configuring a reward processing controller to retrieve data from said casino management system including player information and monitored gaming machine data;

providing for the storing at a data structure of, (a) data corresponding to prize reward criteria including count criteria defining one or more count limit values and count incrementing or decrementing criteria related to the spending of the player and to be applied to said count values to (i) increment to said one or more count values from a start value including 0 to said limit value or (ii) decrement from one or more selected values to one or more limit values including 0, at least one of said prize reward criteria differing based upon the player rating level, (b) data corresponding to eligibility criteria, and (c) data corresponding to reward prizes of a first value for players of a first rating and a second value for players of a second rating;

configuring said controller to identify the player, process said data to determine if said player has satisfied said prize reward and eligibility criteria and, based upon said data corresponding to reward prizes, award a prize of a value corresponding to the player ranking.

19. The method of claim 18 wherein said gaming machines accept different wagering denominations, said method comprising providing for the storage at said data structure of data corresponding to prize reward criteria including count criteria wherein count value for a gaming machine accepting a first wagering denomination is different that for a gaming machine accepting a second denomination.

20. The method of claim 18 comprising providing for the storage, for each player, their current count value and said configuring said controller to apply said current value when said player initiates a gaming session at any of a plurality of said gaming machines.

21. The method of claim 18 comprising said configuring said controller to track the spending of a group of players toward satisfaction of said prize reward and eligibility criteria.

22. The method of claim 21 comprising providing for the storage at said data structure of data corresponding to a first limit value and a higher limit value and data corresponding to a first prize to be awarded when said count corresponds to said first limit value and a second prize when said count corresponds to said higher count limit.

* * * * *